US011717935B2

(12) United States Patent
Luescher et al.

(10) Patent No.: US 11,717,935 B2
(45) Date of Patent: Aug. 8, 2023

(54) QUICK-CLAMPING DEVICE FOR A PORTABLE MACHINE TOOL

(71) Applicant: Robert Bosch GmbH, Stuttgart (DE)

(72) Inventors: Bruno Luescher, Zofingen (CH); Andreas Zurbruegg, Luterbach (CH); Bruno Sinzig, Oberbipp (CH); Marcus Schuller, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 566 days.

(21) Appl. No.: 16/620,816

(22) PCT Filed: Jul. 5, 2018

(86) PCT No.: PCT/EP2018/068217
§ 371 (c)(1),
(2) Date: Dec. 9, 2019

(87) PCT Pub. No.: WO2019/015980
PCT Pub. Date: Jan. 24, 2019

(65) Prior Publication Data

US 2020/0094373 A1 Mar. 26, 2020

(30) Foreign Application Priority Data

Jul. 20, 2017 (DE) ..... 10 2017 212 526.8

(51) Int. Cl.
*B24B 45/00* (2006.01)
*B24B 23/02* (2006.01)

(52) U.S. Cl.
CPC ..... *B24B 45/006* (2013.01); *B24B 23/028* (2013.01)

(58) Field of Classification Search
CPC ..... B24B 45/006; B24B 23/028
(Continued)

(56) References Cited

U.S. PATENT DOCUMENTS 3,233,908 A * 2/1966 Tietze ..... B23B 31/185 279/157
4,779,382 A * 10/1988 Rudolf ..... B24B 45/006 451/342
(Continued)

FOREIGN PATENT DOCUMENTS

CN 105473282 A 4/2016
DE 43 36 620 A1 5/1995
(Continued)

OTHER PUBLICATIONS

International Search Report corresponding to PCT Application No. PCT/EP2018/068217, dated Oct. 17, 2018 (German and English language document) (7 pages).

*Primary Examiner* — Robert F Long
*Assistant Examiner* — Xavier A Madison
(74) *Attorney, Agent, or Firm* — Maginot, Moore & Beck LLP

(57) ABSTRACT

A quick-clamping device for a portable machine tool, in particular for an angle grinder, includes at least one clamping unit and at least one control unit. The clamping unit includes at least one clamping element mounted movably with respect to a movement axis of the clamping unit so that the clamping unit is configured for tool-free fixing of an insertion tool unit to an output shaft of the portable machine tool. The control unit includes at least one movably mounted control element configured to actuate the clamping unit. The control element is mounted at least in a translatory and/or pivotable manner and is configured to transfer the clamping unit from a clamping position into a release position according to a movement of the control element.

15 Claims, 10 Drawing Sheets

(58) Field of Classification Search
USPC ..... 451/359
See application file for complete search history.

(56) References Cited

U.S. PATENT DOCUMENTS

| | | | | |
|---|---|---|---|---|
| 5,265,343 | A * | 11/1993 | Pascaloff | A61B 17/142 30/348 |
| 5,601,483 | A * | 2/1997 | Rudolf | B24B 23/022 451/344 |
| 6,949,110 | B2 * | 9/2005 | Ark | A61B 17/142 606/147 |
| 7,438,634 | B2 * | 10/2008 | Habele | B27B 5/32 451/353 |
| 10,471,518 | B2 * | 11/2019 | Klabunde | B27B 19/006 |
| 10,828,742 | B2 * | 11/2020 | Luescher | B24B 23/022 |
| 2002/0028644 | A1 * | 3/2002 | Rudolf | B24B 45/006 451/344 |
| 2003/0190877 | A1 | 10/2003 | Gallagher et al. | |
| 2004/0204731 | A1 * | 10/2004 | Gant | B27B 5/32 606/170 |
| 2007/0060030 | A1 * | 3/2007 | Pollak | B27B 5/32 451/359 |
| 2010/0197208 | A1 * | 8/2010 | Blickle | B24B 45/006 451/344 |
| 2012/0074657 | A1 * | 3/2012 | Zhou | B23B 31/4073 279/140 |
| 2012/0139196 | A1 * | 6/2012 | Zhou | B24B 23/022 279/140 |
| 2013/0270780 | A1 * | 10/2013 | Emi | B24B 45/006 279/141 |
| 2014/0084552 | A1 * | 3/2014 | Zieger | B27B 5/32 279/141 |
| 2014/0144662 | A1 | 5/2014 | Zhou | |
| 2014/0183828 | A1 | 7/2014 | Xu et al. | |
| 2014/0191481 | A1 * | 7/2014 | Kawakami | B23D 61/006 279/142 |
| 2017/0080545 | A1 | 3/2017 | Furusawa et al. | |

FOREIGN PATENT DOCUMENTS

| | | | |
|---|---|---|---|
| DE | 100 39 739 | A1 | 2/2002 |
| DE | 16 2005 047 400 | B3 | 12/2006 |
| DE | 10 2011 003 100 | A1 | 7/2012 |
| DE | 20 2013 104 204 | U1 | 1/2014 |
| DE | 11 2013 000 831 | T5 | 10/2014 |
| EP | 1 180 416 | A2 | 2/2002 |
| JP | S60-180763 | A | 9/1985 |
| JP | 2015-127075 | A | 7/2015 |
| JP | 2016-529119 | A | 9/2016 |

* cited by examiner

QUICK-CLAMPING DEVICE FOR A PORTABLE MACHINE TOOL

This application is a 35 U.S.C. § 371 National Stage Application of PCT/EP2018/068217, filed on Jul. 5, 2018, which claims the benefit of priority to Serial No. DE 10 2017 212 526.8, filed on Jul. 20, 2017 in Germany, the disclosures of which are incorporated herein by reference in their entirety.

BACKGROUND

A quick-change clamping device for a portable power tool, in particular for a power angle grinder, has already been proposed.

SUMMARY

The disclosure proposes a quick-change clamping device for a portable power tool, in particular for a power angle grinder, having at least one clamping unit that, for the purpose of fixing an insert tool unit to an output shaft of the portable power tool without the use of any tools, has at least one clamping element that is mounted so as to be movable, at least, about and/or along a movement axis of the clamping unit, and having at least one control unit, having at least one movably mounted control element, at least for actuating the clamping unit, wherein the control element is designed, at least, to bring the clamping unit from a clamping position into a release position in dependence on a movement of the control element, wherein the control element is mounted in an at least translational and/or pivotable manner. "Designed" is to be understood to mean, in particular, specially programmed, configured and/or equipped. That an element and/or a unit are/is designed for a particular function is to be understood to mean, in particular, that the element and/or the unit fulfill/fulfils and/or execute/executes this particular function in at least one application state and/or operating state. "Movably mounted" is to be understood to mean, in particular, a mounting of an element and/or of a unit, the element and/or the unit having a movement capability, in particular dissociated from an elastic deformation of the element and/or of the unit, along at least one movement axis, of more than 5 mm, preferably of more than 10 mm, and particularly preferably of more then 50 mm, and/or about a movement axis, in an angular range of more than 1°, preferably of more than 5°, and particularly preferably of more than 15°.

Advantageously, the quick-change clamping device is mounted, at least largely, in an inner region of a transmission housing unit of the portable power tool, and at least one structural unit and/or one structural element of the quick-change clamping device may be arranged on an exterior of the transmission housing unit of the portable power tool, and/or may project, at least partly, from the transmission housing unit. In particular, the quick-change clamping device is designed to fix an insert tool unit to an output shaft of the portable power tool that is preferably realized as a hollow spindle, and preferably to mount it in a rotatable manner. Preferably, the quick-change clamping device is designed to fix the insert tool to the output shaft, advantageously, without the use of any tools. The expression "at least largely" is to be understood in this case to mean, in particular, at least 55%, advantageously at least 65%, preferably at least 75%, particularly preferably at least 85%, and particularly advantageously at least 95% of an outer form, of a surface of an outer form, of an outer contour, of a mass and/or of a volume of a structural unit and/or of a structural element.

Preferably, the clamping unit is arranged, at least largely, in an inner region of the transmission housing unit of the portable power tool. In particular, the clamping unit has at least one clamping element that is arranged, at least partly, in the output shaft.

Preferably, the output shaft surrounds the clamping element, in particular at least partly, in particular completely, along a circumferential direction around a rotation axis of the output shaft. Preferably, the clamping element is connected to the output shaft in a rotationally fixed manner. Preferably, the clamping element is mounted so as to be pivotable about a pivot axis of the clamping element, in particular relative to the output shaft. Preferably, the pivot axis of the clamping element runs transversely, in particular at least substantially perpendicularly, in relation to a rotation axis of the output shaft. Preferably, the pivot axis of the clamping element is aligned at least substantially perpendicularly in relation to a movement axis of the clamping unit. A "movement axis of the clamping unit" is to be understood here to mean, in particular, an axis of the clamping unit along which an axial securing force of the clamping unit can be exerted upon the insert tool unit for the purpose of fixing the insert tool unit to the output shaft, and/or along which a transmission element of the clamping unit is movably mounted for the purpose of moving the clamping element. "At least substantially perpendicularly" is to be understood to mean, in particular, an alignment of a direction relative to a reference direction, the direction and the reference direction, in particular as viewed in a plane that extends parallel to the directions, including an angle of at least approximately 90° and the angle having a maximum deviation of, in particular, less than 8°, advantageously less than 5°, and particularly advantageously less than 2°.

Preferably, the clamping element is realized as a clamping jaw. The at least one clamping element is designed to clamp and/or fix the replacement tool unit to the clamping unit and/or to the output shaft by non-positive and/or positive engagement, at least in a clamping position.

Preferably, the clamping element is designed, at least, to fix the insert tool unit axially to the output shaft. The clamping element, at least in the clamping position, preferably engages, at least in part, in the insert tool unit, in particular in a fixing recess of the insert tool unit. In addition, the clamping element can be arranged in a release position, which differs from the clamping position and in which the replacement tool unit is free from application of force by the clamping element and/or by the clamping unit.

Preferably, the clamping unit comprises at least two movably, in particular pivotably, mounted clamping elements. It is also conceivable, however, for the clamping unit to comprise a number of clamping elements other than two. Preferably, the at least two clamping elements are of an at least substantially similar design.

Preferably, the at least two clamping elements of the clamping unit are mounted so as to be movable relative to each other, in particular pivotable relative to each other, in particular about the pivot axis. In particular, the at least two clamping elements can be brought, by means of the control unit, into a clamping position of the clamping elements and/or into a release position of the clamping elements. Preferably, the at least two clamping elements can be brought, in particular moved, jointly by means of the control unit, in particular jointly into the clamping position and/or into the release position. It is also conceivable, however, that the at least two clamping elements can be brought independently of each other, by means of the control unit, into the clamping position and/or into the release position.

In particular, the clamping unit is connected by non-positive and/or positive engagement to the control unit, at least in an operating state, in particular for the purpose of bringing the clamping unit from the clamping position into the release position. In particular, the clamping unit may contact the control unit. Preferably, the clamping unit is connected by non-positive and/or positive engagement to the control unit at least in the release position, and the clamping unit may additionally be connected to the control unit in the clamping position. Preferably, the control unit has at least one actuating element, which preferably may be realized as a cylinder, as a rectangular solid, as a rod, as a sphere and/or as an actuating element considered appropriate by persons skilled in the art. Preferably, the actuating element is arranged, at least largely, in an inner region of the transmission housing unit. Advantageously, the actuating element is at least in part, advantageously completely, surrounded by the output shaft along a circumferential direction of the actuating element, along a circumferential direction that runs around a rotation axis of the output shaft. Alternatively or additionally, the actuating element may be connected, by means of a guide recess and/or a groove, to corresponding groove projections of the output shaft. In addition, the control unit may have at least one further actuating element, which may be, at least partly, structurally identical to and/or different from the actuating element.

In particular, the actuating element has at least one main direction of extent that is aligned at least substantially parallel to the rotation axis of the output shaft. In addition, the actuating element has at least one movement axis that is at least substantially, and preferably completely, parallel to the rotation axis of the output shaft. In particular, the actuating element is designed, by means of a translational movement parallel to the direction of movement, to transmit an operator force, exerted by an operator upon the control element of the control unit, to the clamping unit, and to cause the clamping unit to be brought from the clamping position into the release position. "At least substantially parallel" is to be understood here to mean, in particular, an alignment of a direction relative to a reference direction, in particular in a plane, the direction deviating from the reference direction by, in particular, less than 8°, advantageously less than 5°, and particularly advantageously less than 2°.

In particular, the control element, in at least one operating state of the quick-change clamping device, is at least in contact with, and advantageously connected by non-positive and/or positive engagement to, the actuating element, in particular for the purpose of moving the clamping unit from the clamping position into the release position. In addition, advantageously at least in the release position, the control element is connected by non-positive and/or positive engagement to the actuating element. The actuating element is designed to transmit an operator force, exerted by an operator upon the control unit, in particular upon the control element, and/or a torque, exerted by an operator upon the control unit, in particular upon the control element, to the actuating element for the purpose of bringing the clamping unit from the clamping position into the release position. Preferably, the control element is arranged, at least largely, on an exterior of the transmission housing unit, a contact region between the control element and the actuating element being arranged, at least in part, in an inner region of the transmission unit. Alternatively, it is also conceivable for the contact region between the control element and the actuating element to be located on an exterior of the transmission housing unit, the actuating element consequently being arranged, at least partly, in the outer region of the transmission housing unit. Preferably, the control element is realized as a force transmission component and/or as a torque transmission component, and is designed to be actuated by an operator's hand, the control element having at least one control position and at least one further control position that is realized so as to be at least partly different and/or separate from the control position. In particular, at least the control position of the control element can be assigned to the clamping position of the clamping unit, and the further control position can be assigned to the release position of the clamping unit. In particular, by means of a movement of the control element, a control position can be brought at least substantially continuously and/or discretely from the release position into the clamping position, and/or from the clamping position into the release position, of the clamping unit. In particular, an at least substantially continuous movement of the control element provides a multiplicity of control positions of the control element, which are arranged between a control position that can be assigned to the clamping position and a further control position that can be assigned to the release position, and which can at least partly realize the release position and/or the clamping position of the clamping unit.

The design according to the disclosure makes it possible, advantageously, to mount an insert tool unit without the use of tools, and thus to achieve highly convenient mounting and, for the purpose of realizing the release position, loss of an operator force applied by the operator can advantageously be kept to a low level. Moreover, it is possible to achieve safe and particularly convenient movement between the clamping position and the release position, as a result of which a particularly safe fixing and/or release of the insert tool unit can additionally be achieved.

Moreover, it is proposed that the control element be realized as a twist switch or as a rotary lever, and have at least one movement axis that is at least substantially parallel to the movement axis of the clamping unit. Preferably, at least the control element realized as a rotary lever or as a twist switch has at least one movement axis, and the control element is mounted so as to be at least partly pivotable and/or rotatable about same, the rotational movement of the control element, advantageously relative to the movement axis, additionally effecting a translational movement of the control element, advantageously at least substantially parallel to the movement axis of the clamping unit. Preferably, a mid-point of the control element that is arranged on the movement axis of the control element moves, by means of the rotary movement, translationally parallel to the movement axis of the clamping unit. Alternatively, the control element may also be realized as a rotary button, as a rotary knob and/or as a control element considered appropriated by persons skilled in the art. Preferably, the control element is mounted so as to be rotatable by at least 10°, advantageously by at least 40°, and preferably by at least 70°, and particularly advantageously by at least 90°, about the movement axis of the control element. Particularly preferably, the control element is mounted so as to be rotatable by at least 90°. Moreover, the control element is advantageously mounted so as to be rotatable by at most 360°, preferably by at most 270°, and particularly preferably by at least 180°. Alternatively, however, it is also possible for the control element to be mounted so as to be rotatable by a value of more than 360° and/or by a multiple of 360°. In particular, by means of a movement of the control element relative to the movement axis of the control element, the clamping unit can be brought from the release position into the clamping position, or from the clamping position into the release position. The design according to the disclosure makes it possible to achieve a direct transmission of force parallel to the movement axis of the clamping unit, and losses of force can be kept to a minimum. Moreover, a rotational movement of the control element enables an additional torque to be generated, with the result that expenditure of force for the purpose of realizing the clamping position can be kept to a low level.

Furthermore, it is proposed that the control unit have at least one control gear unit, in particular a rack-and-pinion gear unit, a cam gear unit and/or a toggle gear unit, which is designed to act in combination with the control element. In particular, the control gear unit is connected to the control unit, at least partly, by non-positive and/or positive engagement, and particularly preferably is realized at least partly integrally. Preferably, at least one component of the control gear unit is realized so as to be integral with the control element and/or with the actuating element. "At least partly integrally" in this context is to be understood to mean, in particular, that at least one component of at least one object, and/or at least one first object, is realized so as to be integral with at least one component of at least one further object, and/or integrally with at least one further object. "Integral" is to be understood to mean, in particular, connected at least in a materially bonded manner, for example by a welding process, an adhesive process, an injection process and/or another process considered appropriate by persons skilled in the art, and/or, advantageously, formed in one piece such as, for example, by being produced from a casting and/or by being produced in a single or multi-component injection process and, advantageously, from a single blank. In particular, at least one control gear unit is realized as a toggle gear unit, and comprises at least one toggle gear joint, and at least one toggle gear element that is realized, at least, so as to be operatively connected to the control element and/or the actuating element, and/or is connected by non-positive and/or positive engagement to the control element and/or the actuating element. Advantageously, the toggle gear joint has at least one toggle gear element that is integrally connected to the control element and/or the actuating element. Preferably, the toggle gear element is realized as a flat or round rod that is mounted so as to be rotatable, preferably, about a rotation axis of the toggle gear joint, as a cutout realized as a coulisse guide and/or as a guide recess for receiving with non-positive and/or positive engagement, at least partly, a guide pin, guide tooth, guide projection or the like that corresponds, at least, to the cutout and/or to the guide recess, and/or as a toggle gear element considered appropriated by persons skilled in the art. Preferably, the toggle gear unit has at least one further toggle gear element that, preferably, is rotatably connected to the toggle gear element or that, alternatively, can be connected by non-positive and/or positive engagement to the toggle gear element. In particular, at least one toggle gear element is connected by non-positive and/or positive engagement, and preferably integrally, to the control element, at least partly, and in particular is designed to transmit an operator force and/or a torque, exerted by an operator upon the control element, to the actuating element and/or the clamping unit. Preferably, at least one toggle gear element is designed, for the purpose of transmitting an operating force, at least to contact the actuating element, and/or to be connected by non-positive and/or positive engagement, advantageously rotatably, to the actuating element and/or to a rotary connecting bolt that is connected by non-positive and/or positive engagement to the actuating element or, advantageously, realized so as to be integral with the actuating element.

Alternatively or additionally, the control gear unit may have at least one rack-and-pinion gear unit that, advantageously, is connected at least by non-positive and/or positive engagement and, advantageously, integrally, at least partly, to the actuating element and/or the control element. Preferably, the rack-and-pinion gear unit has at least one rack-and-pinion gear element, which is realized as a gear-tooth profile having a plurality of tooth cutouts, and which is arranged along the actuating element, the tooth cutouts preferably being arranged along the direction of main extent of the actuating element. Alternatively, it is conceivable to realize the first rack-and-pinion gear element with serration recesses, corrugations and/or with a shape considered appropriated by persons skilled in the art. Preferably, the control gear unit has at least one second rack-and-pinion gear element, which correlates with at least one tooth cutout of the first rack-and-pinion gear element, and which is realized as serrations, as a pin, as a bolt, and preferably as a tooth and which, advantageously, is resiliently connected to the control element and designed to be connected by non-positive and/or positive engagement to at least one tooth cutout of the first rack-and-pinion gear element. Preferably, the second rack-and-pinion gear element is additionally mounted in a translatory manner, in particular along a translation axis aligned at least substantially perpendicularly in relation to the movement axis of the control element, and is advantageously designed as a pawl, in particular as a locking pawl, or the like. Alternatively, it is conceivable for the first rack-and-pinion gear element to be integrally connected to the control element, and for the second rack-and-pinion gear element to be connected at least by non-positive and/or positive engagement to the actuating element.

Furthermore, the control gear unit may comprise at least one cam gear unit, which may be realized as cam gear unit having a slot guide, and/or a cam gear unit as a latching gear unit. In particular, the cam gear unit is designed to transmit a torsional force, in particular a torque, to the actuating element. In particular, the cam gear unit comprises at least first cam gear element, advantageously realized as a control element, which is realized, at least partly, as a cylinder body and which has at least one cavity that is arranged at least substantially in relation to an axis of symmetry of the first cam gear element, in particular in relation to the movement axis of the control element. Preferably, the first cam gear element has at least one slot cutout, realized as a cutout that extends through, preferably radially, from an outer region of the first cam gear element into the cavity. Advantageously, the slot cutout is realized in the circumferential direction, along the circumference of the first cam gear element; alternatively, the slot cutout may also have a thread-type alignment of the slot cutout relative to the first cam gear element. The slot cutout in this case is realized around at least 10°, advantageously around at least 50°, preferably around at least 90°, and particularly preferably around at least 180° of a circumferential angle along the circumference of the first cam gear element. Moreover, the slot cutout is realized around at most 350°, advantageously around at most 300°, preferably around at most 270°, and particularly preferably around at most 210° of a circumferential angle along the circumference in a circumferential region of the first cam gear element. Very particularly preferably, the slot cutout is realized around at least 180° of a circumferential angle along the circumference, in particular along half of a circumference, in a circumferential region of the first cam gear element. In particular, the actuating element has a second cam gear element, which is realized so as to correspond to the first cam gear element, for example as a bolt arranged at least substantially parallel to the movement axis of the control element, and which is designed to be connected by positive engagement and/or captively to the first cam gear element. The first cam gear element is advantageously mounted so as to be rotatable about a movement axis of the control element that is at least substantially perpendicular to the movement axis of the clamping unit. Consequently, the first cam gear element, in particular the cavity, achieves an eccentric rotation, the second cam gear element and the actuating element being translationally movable along the movement axis of the clamping unit. In addition, the control unit may have at least one further cam gear element, which may be at least partly structurally identical to the first or the second cam gear element. Alternatively, a first cam gear element may be realized as a substantially full body, and have a slot cutout in the form of a thread cutout for positively guiding a second cam gear element, which is realized as a guide pin, guide projection and/or guide tooth. Furthermore, a movement axis of the first cam gear element may be realized so as to be at least substantially parallel to the movement axis of the clamping unit, in particular for the purpose of realizing a pivoted lever. Moreover, it is conceivable for the first cam gear element, at least partly, to have an oval outer contour and, by means of a rotational movement, to cause the first cam gear element to be in contact with the second cam bear element, and consequently to cause a translational movement of the actuating element contacted by the cam gear element. The design according to the disclosure makes it possible, in particular, to realize a control unit that is particularly stable and easy to operate. Furthermore, it is possible to achieve particularly efficient transmission of an operator force and/or of a torque that is applied to the control unit by the operator. Moreover, it is possible to realize a control unit that is particularly saving of material, as a result of which, in addition, material costs can be kept to a low level.

It is additionally proposed that the control unit have at least one conversion element, in particular a cam track of a cam gear unit of the control unit, which is designed to convert a pivot movement of the control element about a movement axis of the control element into a translational movement of the control element along the movement axis of the control element. Preferably, the conversion element is realized as a cylindrical conversion element, and is advantageously mounted so as to be rotatable about the movement axis of the control element. Advantageously, the conversion element has a thread, along the circumference of the conversion element, and/or has a slot cutout, in particular extending in the manner of a thread, which is designed to receive with positive engagement a further thread that corresponds to the thread and/or the slot cutout and that is realized on an inner wall of a control housing element of the control unit. Advantageously, a rotational and/or pivot movement causes the control element to move about the movement axis of the control element, the conversion element to move translationally along the movement axis of the clamping unit. Alternatively or additionally, the control unit, in particular the inner wall of the control housing element, may have at least one thread that corresponds to the thread and/or the slot cutout, a guide pin that corresponds to the thread and/or the slot cutout, a guide tooth, a guide projection and/or a further cam gear element considered appropriated by persons skilled in the art. The design according to the disclosure makes it possible, advantageously, to realize operation of the control unit with a particularly small expenditure of force, enabling the clamping unit to be brought particularly easily and conveniently into the release position.

It is additionally proposed that the control element have a movement axis that runs transversely in relation to the movement axis of the clamping unit, wherein the control element is mounted so as to be translationally movable along the movement axis. A "movement axis that is aligned transversely in relation to the direction of movement of the clamping unit" is to be understood in this context to mean, in particular, that at least one, in particular essential, directional component of the movement axis of the control element is aligned perpendicularly in relation to the movement axis of the clamping unit. Advantageously, the control element is realized as a slide switch that is mounted so as to be translationally movable by means of at least one guide element, a sliding force exerted by an operator along the movement axis of the control element being convertible into a translational movement of the clamping unit along the movement axis of the clamping unit. Advantageously, the control unit has at least one further guide element. Moreover, it is conceivable for the movement axis of the control element to be aligned at least substantially perpendicularly in relation to the movement axis of the clamping unit. The design according to the disclosure makes it possible, advantageously, to realize particularly simple operation of the control element, enabling particularly rapid mounting of an insert tool to be achieved. Moreover, it is possible to realize a control element that is particularly saving of structural space.

Furthermore, it is proposed that the control element be realized as a pushbutton. In particular, the control element is designed to transmit a force, in particular a pressure force, exerted at least substantially vertically, in particular at least substantially parallel to the movement axis of the clamping unit, upon the control element by an operator, to the actuating element and/or the clamping unit. The control element advantageously has at least one contact bolt that, at least largely, is arranged in an inner region of the transmission housing unit and that is connected at least by non-positive and/or positive engagement, and preferably in part integrally, to the pushbutton. Advantageously, the contact bolt is designed to be contacted, at least in an operating state, for the purpose of moving the clamping unit from the clamping position into the release position, and to transmit the operator force to the actuating element and/or the clamping unit. Advantageously, for the purpose of providing a restoring force, at least the pushbutton is mounted by means of a preferably resilient restoring element. Preferably, the pushbutton is formed from a plastic, it also being conceivable for the pushbutton to be made, at least partly, from a metal. The design according to the disclosure makes it possible, advantageously, to achieve a direct transmission of force from the operator to the clamping unit, such that an expenditure of force for realizing the release position can be kept to a low level. Moreover, it is possible to achieve a control element that is particularly saving of structural space and/or material.

Furthermore, it is proposed that the control element have a movement axis that runs at least substantially parallel to the movement axis of the clamping unit. Advantageously, the movement axis runs completely parallel to the movement axis of the clamping unit. In particular, the control element and the actuating element realize a contact region, via which the pressure force applied by the operator can be transmitted to the actuating element. Alternatively, the control element may be realized as a push-lever, the push-lever being rotatably mounted and having at least one contact bolt, mounted eccentrically on the control element, for transmitting a pressure force to the actuating element. Furthermore, the control element may have a movement axis that forms an angle with the movement axis of the clamping unit, in which case the movement axis of the control element and the movement axis of the clamping unit may be aligned at least substantially perpendicularly in relation to each other, or may include an obtuse angle. In this case, it is conceivable for transmission of an operator force from the control element to the actuating element to be effected by means of a conversion element. The design according to the disclosure makes it possible to achieve a direct transmission of force from the control element to the actuating element, such that an expenditure of force for realizing the release position, and also material wear, can be kept to a low level.

It is additionally proposed that the control element be realized as a tilt switch, and have a movement axis that runs at least substantially perpendicularly in relation to the movement axis of the clamping unit. In particular, the control element has at least two switch positions, the control element realizing a first switch position, for realizing the clamping position, and at least one second switch position, for realizing the release position of the clamping position. In particular, the first switch position can be set by actuation of a first end of the control element, and the second switch position can be set by actuation of an end of the control element that is opposite to the first end. In particular, the first switch position and the at least second switch position can be set by a rotational and/or tilting movement of the control element realized as a tilt switch, the control element advantageously being mounted so as to be rotatable about a movement axis that is at least substantially perpendicular to the movement axis of the clamping unit. Alternatively or additionally, the control element may have at least one colored light, whereby usability of the portable power tool can be indicated in color, for example by a red or green light, depending on the switch position. Moreover, it is conceivable for the control unit to have an electronic control element, in particular realized as a touch display, wherein a translation of the actuating element and/or the clamping unit can be effected electronically by means of an electromagnetic field and/or by means of an electric motor. The design according to the disclosure makes it possible to realize a particularly simple and intuitive control element with direct transmission of force, which also exhibits particularly low material wear and a long service life.

It is additionally proposed that, for the purpose of transmitting an actuating force to the clamping unit, on a side facing toward the clamping unit the control element have at least one actuating region, which is inclined relative to a movement axis of the control element, in particular is realized as an inclined plane. In particular, the actuating region realizes a plane having at least one component that, along the movement axis of the clamping unit, is inclined in relation to the movement axis of the control element, and that advantageously includes an acute angle with the movement axis of the control element. Moreover, the movement axis of the control element includes an acute angle with the at least one component of the actuating region, in a direction of the movement axis of the control element. In particular, by means of a movement of the control element along the movement axis of the control element, the actuating region realizes a contact region with the actuating element, at least for the purpose of transmitting an operator force to the actuating element for the purpose of realizing the release position of the clamping unit. Advantageously, for the purpose of realizing an at least substantially frictionless contact region between the control element and the actuating element, the actuating element has at least one preferably dynamically, in particular rotatably, mounted guide element, for example a rolling cylinder, a rolling wheel, a sphere and/or a guide element considered appropriated by persons skilled in the art, on a side of the actuating element that faces toward the control element. The design according to the disclosure makes it possible for an operator force to be transmitted particularly easily to the clamping unit and, advantageously, a production resource requirement, and consequently production costs, can be kept to a low level.

It is also proposed that the quick-change clamping device have at least one holding unit, which has at least one positive-engagement element and/or a magnetic element for holding the control element in at least one movement position of the control element. In particular, the holding unit is designed to fix the control element at least in the clamping position and/or in the release position of the clamping unit, by means of the positive-engagement element and/or the magnetic element, the holding unit advantageously being connected at least by non-positive and/or positive engagement to the transmission housing unit. It is also conceivable for the holding unit to be integrally connected, at least in part, to the transmission housing unit. In particular, the positive-engagement element is advantageously made from an elastic material, at least partly, and is designed to encompass the control element, at least partly and preferably at least to a large extent, for the purpose of fixing. Preferably, the positive-engagement element has an at least partly U-shaped cross section, having at least one positive-engagement limb that at least partly encompasses the control element. Preferably, the positive-engagement element has a second positive-engagement limb, which is of a design analogous to that of the positive-engagement element and is arranged on the side of the positive-engagement element that is opposite to the positive-engagement limb, and which encompasses the control element, at least partly, for the purpose of fixing. Preferably, the positive-engagement element, in particular the positive-engagement limbs, realizes/realize at least one latching connection to a latching recess of the control element. Alternatively, a positive-engagement element may be realized as a ring and/or claw that, at least in sections, and advantageously completely, encompasses the control element with positive engagement. In addition, the holding element may have a magnetic element, which is connected by non-positive and/or positive engagement to the transmission housing unit, and which is designed to fix at least one control element that is made, at least in part, from an, in particular, ferromagnetic material, by means of a magnetic force. It is also conceivable that, for the purpose of reinforced fixing, the holding unit has at least one positive-engagement element and at least one magnetic element. The design according to the disclosure makes it possible to maintain safety of the quick-change clamping device and to prevent involuntary operation of the control element. In addition, the, in particular space-saving, fixing of the control element makes it possible to achieve particularly convenient operation of the portable power tool.

Furthermore, it is proposed that the holding unit have at least one holding element, realized as a latching element, to which a spring force is applied by means of a holding spring element of the holding unit. Preferably, the holding element is connected at least by non-positive and/or positive engagement to the transmission housing unit, and is designed to fix a control element at least in the clamping position by non-positive and/or positive engagement. Advantageously, the holding element is at least partly integrally connected to the positive-engagement element. In particular, the holding element has at least one latching recess, and/or a latching element that is designed for latching connection to a further latching lug and/or latching recess of the control element that corresponds to the latching recess and/or the latching element of the holding element. Advantageously, the holding element is realized as a latching pawl and/or as a restoring latching element, and has at least one resilient element, in particular a restoring spring, that is designed to apply a spring force to the holding element during a latching connection. In particular, an actuation of the holding element causes the latching connection between the holding unit and the control element to be released. Alternatively, the holding element may have a catch-on element, in particular a catch-on hook, a catch-on projection and/or a catch-on region that is designed for releasable catch-on connection to a corresponding catch-on element of the control element. The design according to the disclosure makes it possible to achieve a fixing of the control element that is particularly easy to operate, secure and space-saving.

It is additionally proposed that the quick-change clamping device have at least one damping unit, for damping a restoring movement of the control element. Advantageously, the damping unit is designed to prevent a restoring movement, upon the release of the clamping position of the clamping unit, an abrupt movement of the control element and/or of the actuating element. In particular, the damping element is designed to provide a force that opposes a restoring force, for the purpose of at least partly compensating the restoring force. In particular, the damping unit is connected to the holding unit and/or to the transmission housing unit, at least partly, by non-positive and/or positive engagement, and arranged at least in the region close to the holding unit. The design according to the disclosure makes it possible to realize particularly safe release of the control element from the holding unit, while jamming can be prevented and material wear of the clamping unit and of the control unit can be kept to a low level, owing to a damped restoring movement, such that consequently a long service life of the quick-change clamping device can be achieved.

It is also proposed that the damping unit, in particular the damping unit introduced above, be realized as a wrap spring brake. Preferably, the damping unit has a wrap spring element, which may be realized, for example, as an at least partly metallic wire and/or cable and advantageously has at least one further winding around a brake body, and which is designed, upon extension of the wrap spring element, by means of a spring force of the wrap spring element, to exert at least a frictional force upon the brake body, an extensibility of the warp spring element being reducible by the frictional force. In particular, at one end of the wrap spring element, the wrap spring element is at least connected by non-positive and/or positive engagement to the control element, and at the other end of the wrap spring element, opposite to the first end, is at least by non-positive and/or positive engagement connected to the holding unit and/or to the transmission housing unit. The design according to the disclosure makes it possible to provide a particularly simple damping unit, and a particularly space-saving arrangement of the damping unit can be achieved.

Also proposed is a portable power tool, in particular a power angle grinder, having at least one quick-change clamping device as claimed in any one of the preceding claims. A "portable power tool" is to be understood here to mean, in particular, a power tool, for performing work on workpieces, that can be transported by an operator without the use of a transport machine. The portable power tool has, in particular, a mass of less than 40 kg, preferably less than 10 kg, and particularly preferably less than 5 kg. Particularly preferably, the portable power tool is realized as a power angle grinder. It is also conceivable, however, for the portable power tool to be of a different design, considered appropriate by persons skilled in the art, such as, for example, designed as a circular saw machine, as a power sander, or the like. The portable power tool preferably comprises an output shaft that can be driven in rotation. Preferably, the quick-change clamping device is arranged on the output shaft. Preferably, the quick-change clamping device is arranged, at least partly, in the output shaft. Preferably, the output shaft is realized as a hollow shaft. In particular, the portable power tool, together with an insert-tool unit that can be fixed to the output shaft by means of the quick-change clamping device, forms a power-tool system. The design according to the disclosure makes it possible, advantageously, to mount an insert tool unit without the use of any tools, and thus to achieve highly convenient mounting and, for the purpose of realizing the release position, loss of an operator force applied by the operator can advantageously be kept to a low level. Moreover, it is possible to achieve safe and particularly convenient movement between the clamping position and the release position, as a result of which a particularly safe fixing and/or release of the insert tool unit can additionally be achieved.

The quick-change clamping device according to the disclosure and/or the portable power tool according to the disclosure are/is not intended in this case to be limited to the application and embodiment described above. In particular, the quick-change clamping device according to the disclosure and/or the portable power tool according to the disclosure may have individual elements, component parts and units that differ in number from a number stated herein, in order to fulfill an operating principle described herein.

BRIEF DESCRIPTION OF THE DRAWINGS

Further advantages are disclosed by the following description of the drawings. The drawings show 18 exemplary embodiments of the disclosure. The drawings, the description and the claims contain numerous features in combination. Persons skilled in the art will also expediently consider the features individually and combine them to create appropriate further combinations.

There are shown.

DETAILED DESCRIPTION

Figure 1A:
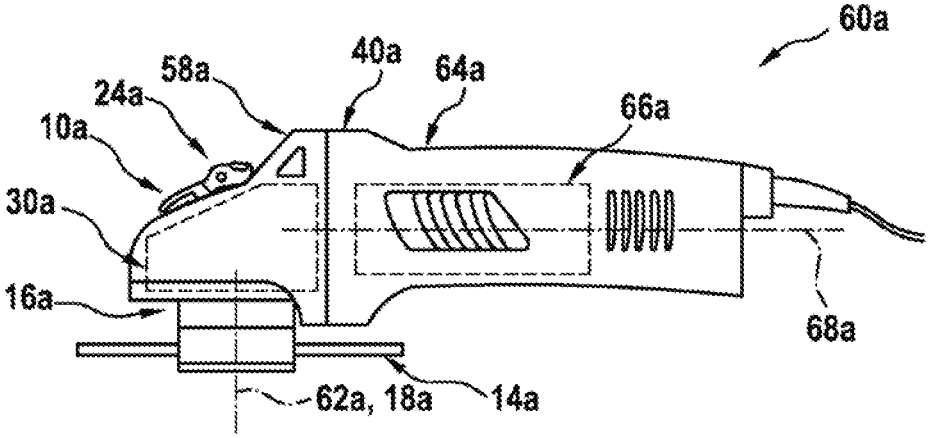
FIG. 1*a* a portable power tool, having a quick-change clamping device according to the disclosure, in a schematic representation, FIG. 1*b* a sectional view of the portable power tool from FIG. 1*a*, having the quick-change clamping device, in a schematic representation, FIG. 2 a control unit according to the disclosure of a quick-change clamping device according to the disclosure, in a perspective detail view, FIG. 3 a further exemplary embodiment of a control unit according to the disclosure, having a control element realized as a rotary lever, in a perspective detail view, FIG. 4 a further exemplary embodiment of a control unit according to the disclosure, having a control element realized as a rotary lever, in a perspective detail representation.

FIG. 1*a* shows a portable power tool 60*a*, realized as a power angle grinder, having a quick-change clamping device 10*a*. It is also conceivable, however, for the portable power tool 60*a* to be of a different design, considered appropriate by persons skilled in the art, such as, for example, designed as a circular saw machine, as a power sander, or the like. The portable power tool 60*a* comprises a transmission housing unit 58*a* for accommodating and/or mounting a power-tool transmission unit 40*a* of the portable power tool 60*a*. The transmission housing unit 58*a* is preferably made of a metallic material. It is also conceivable, however, for the transmission housing unit 58*a* to be made entirely, largely or at least partly of plastic, and/of a different material, considered appropriate by persons skilled in the art. The power-tool transmission unit 40*a* is preferably realized as a bevel gear transmission. The power-tool transmission unit 40*a* comprises, in particular, an output shaft 16*a*, which can be driven in rotation and to which an insert tool unit 14*a* can be fixed, in particular by means of the quick-change clamping device 10*a*. The output shaft 16*a* is preferably realized as a hollow spindle, in which the quick-change clamping device 10*a* is arranged, at least partly (see FIG. 1*b*). An ancillary handle, not represented in greater detail here, can be arranged on the transmission housing unit 58*a*, in a manner already known to persons skilled in the art. The portable power tool 60*a* comprises a drive housing unit 64*a* for accommodating and/or mounting a drive unit 66*a* of the portable power tool 60*a*. The drive unit 66*a* is preferably designed, in a manner already known to persons skilled in the art, to drive the output shaft 16*a* in rotation about a rotation axis 62*a* of the output shaft 16*a*, by means of a combined action with the power-tool transmission unit 40*a*. The rotation axis 62*a* of the output shaft 16*a* runs at least substantially perpendicularly in relation to a drive axis 68*a* of the drive unit 66*a*. The drive unit 66*a* is preferably realized as an electric-motor unit. It is also conceivable, however, for the drive unit 66*a* to be of a different design, considered appropriate by persons skilled in the art, such as, for example, designed as an internal-combustion drive unit, as a hybrid drive unit, as a pneumatic drive unit, or the like.

Figure 1B:
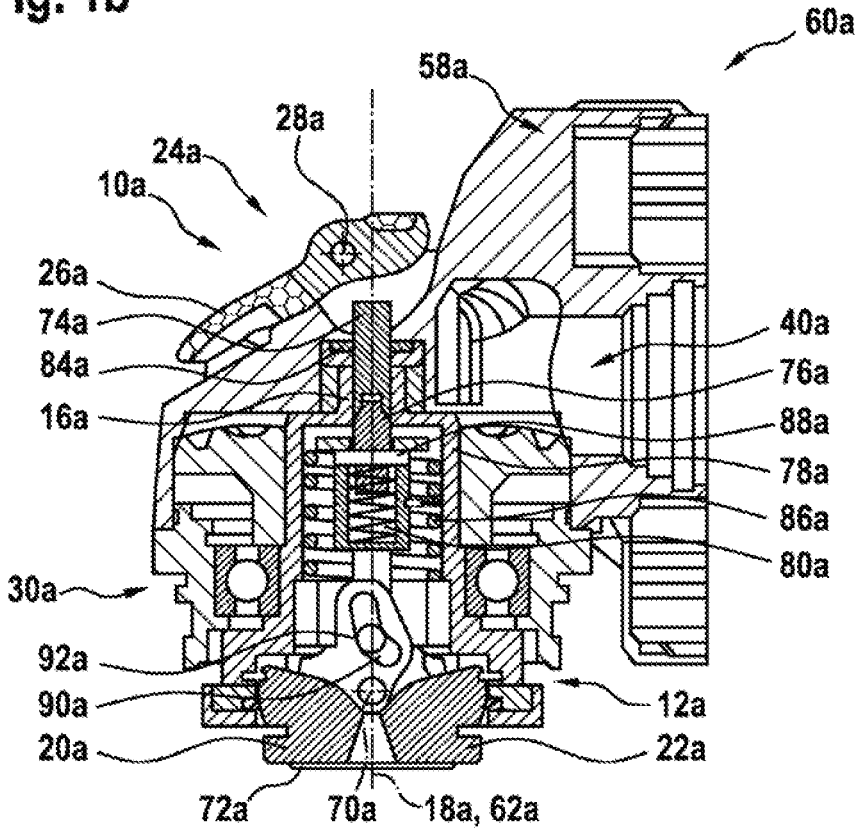

FIG. 1*b* shows a sectional view of the portable power tool 60*a*, in particular in the region of the power-tool transmission unit 40*a*, and of the quick-change clamping device 10*a*. The power-tool transmission unit 40*a* and the quick-change clamping device 10*a* are arranged largely in an inner region transmission housing unit 58*a*. The quick-change clamping device 10*a* for the portable power tool 60*a*, which comprises at least the output shaft 16*a* that can be driven in rotation, comprises at least one clamping unit 12*a* which, for the purpose of fixing the insert-tool unit 14*a* to the output shaft 16*a* without the use of any tools, has at least one movably mounted clamping element 20*a*, 22*a*, for applying a clamping force to the insert-tool unit 14*a* when the clamping element 20*a*, 22*a* is in a clamping position. The quick-change clamping device 10*a* further comprises at least one control unit 24*a*, for moving the clamping element 20*a*, 22*a* into a clamping position, and/or into a release position of the clamping element 20*a*, 22*a* in which the insert-tool unit 14*a* can be removed from the clamping unit 12*a* and/or from the output shaft 16*a*. The clamping unit 12*a* is mounted so as to be translational along a movement axis 18*a* of the clamping unit 12*a*. The clamping unit 12*a* comprises at least two movably mounted clamping elements 20*a*, 22*a*. It is also conceivable, however, for the clamping unit 12*a* to comprise a number of clamping elements 20*a*, 22*a* other than two. The at least two clamping elements 20*a*, 22*a* are of a substantially similar design, such that features disclosed in connection with one of the clamping elements 20*a*, 22*a* are to be considered as also having been disclosed for the further clamping element 20*a*, 22*a*. The at least two clamping elements 20*a*, 22*a* are mounted so as to be pivotable about a pivot axis 70*a*. The pivot axis 70*a* of the at least two clamping elements 20*a*, 22*a* is at least substantially perpendicular to the movement axis 18*a* of the clamping unit 12*a*. The at least two clamping elements 20*a*, 22*a* are designed to fix the insert-tool unit 14*a*, when having been arranged on the clamping unit 12*a* and/or on the output shaft 16*a*, axially on the output shaft 16*a*, in particular in the clamping position of the at least two clamping elements 20*a*, 22*a*. The at least two clamping elements 20*a*, 22*a* are connected to the output shaft 16*a* in a rotationally fixed manner. The at least two clamping elements 20*a*, 22*a* can be driven in rotation, together with the output shaft 16*a*, about the rotation axis 62*a*.

The clamping unit 12*a* comprises at least one torque driving element 72*a* for the purpose of transmitting torque to the insert-tool unit 14*a*. When the insert-tool unit 14*a* has been arranged on the clamping unit 12*a* and/or on the output shaft 16*a*, the torque driving element 72*a* engages in a receiving recess (not represented in greater detail here) of the insert-tool unit 14*a* and, for the purpose of transmitting torque, bears against at least one edge of the insert-tool unit 14*a* that delimits the receiving recess. Transmission of torque between the output shaft 16*a* and the insert-tool unit 14*a* arranged on the clamping unit 12*a* and/or on the output shaft 16*a* is preferably effected, in a manner already known to persons skilled in the art, by means of a positive-engagement connection between the torque driving element 72*a* and the insert-tool unit 14*a*. The torque driving element 72*a* is arranged in a rotationally fixed manner on the output shaft 16*a*. The torque driving element 72*a* can be driven in rotation, together with the output shaft 16*a*, about the rotation axis 62*a*.

The control unit 24*a* is preferably designed to move the clamping element 20*a*, 22*a*, in particular the at least two clamping elements 20*a*, 22*a*, at least into the release position, in which the insert-tool unit 14*a* can be removed from the clamping unit 12*a* and/or from the output shaft 16*a*. Alternatively or additionally, it is conceivable for the control unit 24*a* to be designed to move the clamping element 20*a*, 22*a*, in particular the at least two clamping elements 20*a*, 22*a*, at least into the clamping position, in which the insert-tool unit 14*a* can be fixed to the output shaft 16*a* by means of the clamping unit 12*a*. The control unit 24*a* preferably comprises at least one control element 26*a*, which can be actuated by an operator. In the shown exemplary embodiment of the prior art, the control element 26*a* is realized as a control lever. The control element 26*a* comprises a movement axis 28*a* that, in the exemplary embodiment shown, is realized as a further pivot axis or rotation axis of the control element 26*a*, and that is aligned transversely, in particular at least substantially perpendicularly, in relation to the rotation axis 62*a* of the output shaft 16*a*. The control element 26*a* is preferably mounted so as to be rotatable about the movement axis 28*a*. The control element 26*a* is decoupled from a rotary motion of the output shaft 16*a*. The control element 26*a* is designed to actuate an actuating element 74*a*.

The control unit 24*a* comprises the actuating element 74*a*. The actuating element 74*a* is mounted so as to be translational along a movement axis 18*a* of the clamping unit 12*a*. The actuating element 74*a* is realized, at least in part, as a cylinder body, having an at least substantially round cross section, and alternatively or additionally the actuating element 74*a* may have, at least in part, a cross section that is other than a round cross section, for example a square, rectangular and/or polygonal cross section. Advantageously, the actuating element 74*a* is made at least partly from metal, and the actuating element 74*a* may also be made at least partly from a plastic and/or from a material considered appropriated by persons skilled in the art. The actuating element 74*a* is fixed, in the transmission housing unit 58*a*, against rotation relative to the transmission housing unit 58*a*, in particular due to a lateral flattening of the actuating element 74*a* that allows an axial movement and prevents a rotary movement. Arranged on the transmission housing unit 58*a*, in the region of the actuating element 74*a*, there is preferably a sealing element 84*a* such as, for example, a rubber seal or the like, in order, in particular, at least largely to prevent dirt from entering the transmission housing unit 58*a* and/or the clamping unit 12*a*. The control element 26*a* is designed to move the clamping unit 12*a* along the movement axis 18*a* of the clamping unit 12*a* by means of the operator force, and to realize a release position of the clamping unit 12*a*.

The control unit 24*a* comprises a control gear unit 30*a*. The control gear unit 30*a* is arranged, at least partly, in an inner region of the transmission housing unit 58*a* of the portable power tool 60*a*. The control gear unit 30*a* is designed to cause the control element 26*a* to be in contact with the actuating element 74*a*, by means of at least one control gear element. The control gear unit 30*a* is designed to deflect a transmission of an operator force, by means of a control gear joint. For this purpose, the control gear unit 30*a* may have at least one toggle gear unit, rack-and-pinion gear element, cam gear unit and/or other gear unit considered appropriated by persons skilled in the art.

The control unit 24*a* comprises at least one decoupling element 76*a* which, by means of a non-positive engagement connection, can be brought into contact with the actuating element 74*a*, or which is in contact with the actuating element 74*a*. The decoupling element 76*a* is preferably mounted such that it can move translationally along the rotation axis 62*a*. The decoupling element 76*a* comprises, in particular, a conical connection region, which engages, at least partly, in a recess of the actuating element 74*a*. A frictional effect between the actuating element 74*a* and the decoupling element 76*a* depends, in particular, on a design of the conical connection region and on a spring force of a decoupling spring element 80*a* of the control unit 24*a*. The decoupling spring element 80*a* is designed to apply a spring force to the decoupling element 76*a*, in the direction of the actuating element 74*a*. The decoupling spring element 80*a* is arranged in a transmission element 78*a* of the clamping unit 12*a* that is realized as a clamping fork. The transmission element 78*a* is connected in a rotationally fixed manner to the output shaft 16*a*. The transmission element 78*a* can be moved translationally along a movement axis 18*a* of the clamping unit 12*a*, and is movably mounted in the output shaft 16*a*. A spring force can be applied to the transmission element 78*a*, at least by means of clamping spring element 86*a* of the clamping unit 12*a*, along the movement axis 18*a*, in particular in the direction of the control unit 24*a*.

The control unit 24*a* has at least one connection element 88*a*, which is designed to connect the decoupling element 76*a* and the transmission element 78*a* to each other in respect of movement, in particular at least in a state in which the output shaft 16*a* has a low rotational speed, or the output shaft 16*a* is at a standstill. The connection element 88*a* is realized as a bolt. The connection element 88*a* is fixed to the decoupling element 76*a*. The connection element 88*a* can be moved together with the decoupling element 76*a*. Upon a rotational movement of the output shaft 16*a*, the decoupling element 76*a* and the connection element 88*a* can be rotated relative to the transmission element 78*a* as a result of braking by an actuation of the actuating element 74*a*, the connection element 88*a* being movable in a guide coulisse of the transmission element 78*a* that is not shown here, in such a manner that the decoupling element 76*a* can be moved, against a spring force of the decoupling spring element 80*a*, into a guide recess (not shown here) of the transmission element 78*a*. An actuation of the control element 26*a* during a rotary motion of the output shaft 16*a* can be converted into a movement of the actuating element 74*a* and of the decoupling element 76*a* relative to the transmission element 78*a*. To a large extent, movement of the transmission element 78*a* as a result of an action of an operator force by means of the control unit 24*a*, to move the clamping element 20*a*, 22*a*, in particular the clamping elements 20*a*, 22*a*, starting from the clamping position, into the release position during a rotary motion of the output shaft 16*a*, can be prevented. The transmission element 78*a* is designed to bring, in particular to move, the clamping element 20*a*, 22*a*, in particular the clamping elements 20*a*, 22*a*, starting from the clamping position, into the release position.

The clamping element 20*a*, 22*a*, in particular the clamping elements 20*a*, 22*a*, is/are movably, in particular pivotably, mounted on the output shaft 16*a*, in particular in the output shaft 16*a*. The clamping element 20*a*, 22*a*, in particular the clamping elements 20*a*, 22*a*, has/have at least one coulisse element 90*a*, which is designed to act in combination with a coulisse engagement element. The coulisse engagement element is fixed to the transmission element 78*a*. As a result of a combined action of the coulisse engagement element and the coulisse element 90*a*, the clamping element 20*a*, 22*a*, in particular the clamping elements 20*a*, 22*a*, can be moved, starting from the clamping position, into the release position, or from the release position into the clamping position. The clamping element 20*a*, 22*a*, in particular the clamping elements 20*a*, 22*a*, can be brought, starting from the release position, into the clamping position, in particular by means of an action of a spring force of the clamping spring element 86*a* upon the transmission element 78*a*. The clamping element 20*a*, 22*a*, in particular the clamping elements 20*a*, 22*a*, can be moved automatically into the clamping position, in particular following removal of an action of an operator force via the control unit 24*a*, due to an action of a spring force of the clamping spring element 86*a*.

The quick-change clamping device 10*a* comprises at least one securing unit 92*a*, in particular a self-locking unit and/or a latching unit, which is designed, at least in the case of action of a force, dissociated from the control unit 24*a* and acting in the direction of the release position of the clamping element 20*a*, 22*a*, in particular of the clamping elements 20*a*, 22*a*, to prevent a movement of the clamping element 20*a*, 22*a*, in particular of the clamping elements 20*a*, 22*a*, starting from the clamping position, into the release position of the clamping element 20*a*, 22*a*, in particular of the clamping elements 20*a*, 22*a*, from acting upon the clamping element.

FIGS. 2 to 18 show exemplary embodiments of a control unit of a quick-change clamping device. The following descriptions and the drawing are limited substantially to the differences between the exemplary embodiments and, in principle, reference may be made to the drawings and/or the description of the other exemplary embodiment of FIGS. 1*a* and 1*b* in respect of components having the same designation, in particular in respect of components having the same reference numerals. The exemplary embodiments of FIGS. 2 to 18 differ from the exemplary embodiment of FIGS. 1*a* and 1*b* only in the design of the control unit, and in a design of a holding unit and a damping unit. To distinguish the exemplary embodiments, the letter a has been appended to the references of the exemplary embodiment in FIGS. 1*a* and 1*b*. In the exemplary embodiments of FIGS. 2 to 18, the letters b to r have been appended to the references.

Figure 2:
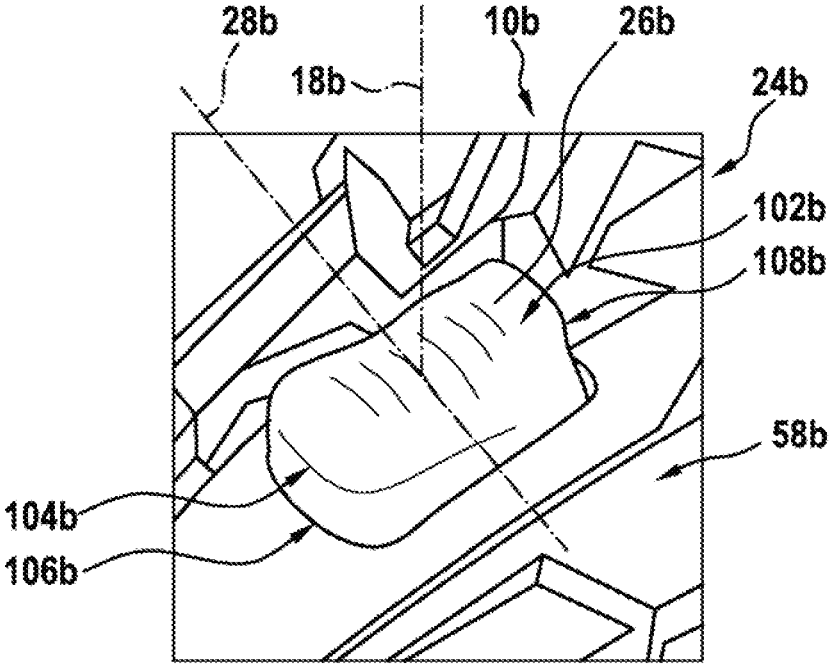

FIG. 2 shows a part of a control unit 24*b* of a quick-change clamping device 10*b* according to the disclosure, in a perspective representation. The quick-change clamping device 10*b* is arranged, at least largely, in an inner region of a transmission housing unit 58*b*, which here is shown only in part. The control unit 24*b* preferably has at least one control element 26*b* The control element 26*b* is arranged on an exterior of the transmission housing unit 58*b*. The control element 26*b* is realized as a tilt switch. The control element 26*b* is made, at least substantially, from plastic. Alternatively, the control element 26*b* may be made, at least partly, from metal, or from a different material, considered appropriated by persons skilled in the art. Moreover, for the purpose of protecting the control element 26*b* and/or the clamping unit from dirt accretion, and/or from involuntary operation by an operator, the control unit 24*b* may have a protective element, which is realized as a preferably protective sleeve, and which at least partly encompasses the control element 26*b*.

The control element 26*b* has a movement axis 28*b*, which is realized as a rotation axis and/or tilt axis. The movement axis 28*b* of the control element 26*b* is at least substantially perpendicular to a movement axis 18*b* of a clamping unit (see FIG. 1*b*), not shown here, of the quick-change clamping device 10*b*. The control element 26*b* has a first end region 102*b*, and a second end region 104*b* that is opposite the first end region 102*b* along the control element 26*b*. The end regions 102*b*, 104*b* are arranged so as to be tiltable about the movement axis 28*b*. The end regions 102*b*, 104*b* are designed to realize two switch positions 106*b*, 108*b*, in particular a first switch position 106*b* and at least one second switch position 108*b*, by means of tilting as a result of an application of operator force upon one of the end regions 102*b*, 104*b*. In the first switch position 106*b*, the control element 26*b* is designed to transmit an operator force to an actuating element, not shown here. In the first switch position 106*b*, the control element 26*b* is designed to realize the release position of the clamping unit, by means of the operator force. For this purpose the control element 26*b*, realized as a tilt switch, has a contact element, not shown here. The contact element is formed, at least largely, from plastic. Alternatively, the contact element may be made at least partly, or completely, from caoutchouc. The contact element is designed to transmit an operator force to an actuating element, not shown here, for the purpose of realizing at least the release position of the clamping unit (see FIG. 1*b*).

In the second switch position 108*b*, the control element 26*b* is designed to realize a clamping position of the clamping unit. In the second switch position 108*b*, the contact element is advantageously not in contact with the actuating element 74*b*. Alternatively, the contact element may be in contact with the actuating element 74*b*. Alternatively, the first switch position 106*b* may be designed to realize the clamping position of the clamping unit, and the second switch position 108*b* designed to realize the release position. Moreover, the control element 26*b* may have further switch positions 106*b*, 108*b*.

Figure 3:
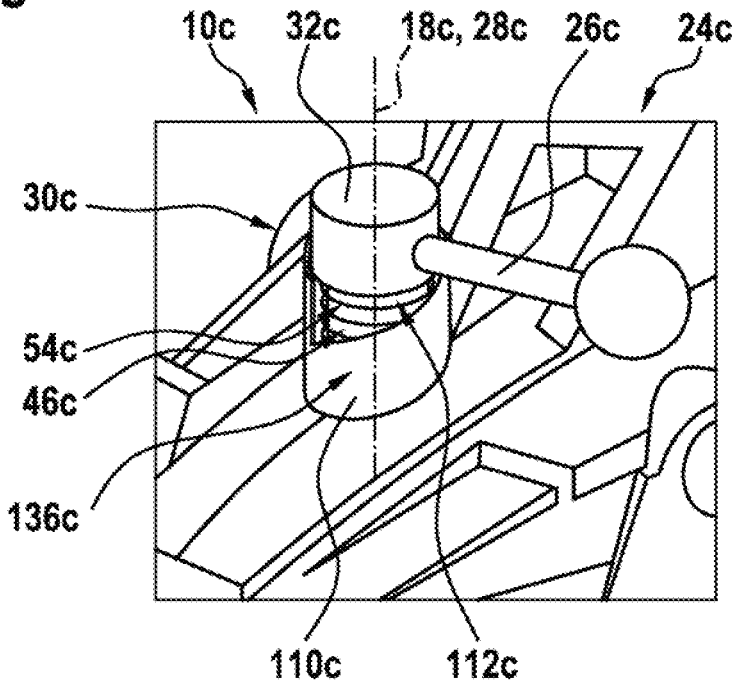

FIG. 3 shows a part of a control unit 24*c* of a quick-change clamping device 10*c* in a perspective representation. The control unit 24*c* has at least one control element 26*c*. The control element 26*c* is realized as a rotary lever. The control element 26*c* is preferably made, at least largely, from metal, for example from aluminum. Alternatively or additionally, the control element 26*c* may be made from a plastic and/or from a material considered appropriated by persons skilled in the art.

The control element 26*c* has at least one movement axis 28*c*. The control element 26*c* is mounted so as to be rotatable about the movement axis 28*c* of the control element 26*c*. The movement axis 28*c* of the control element 26*c* is at least substantially parallel to a movement axis 18*c* of a clamping unit (see FIG. 1*b*), not shown here. Preferably, the control element 26*c* is mounted so as to be rotatable by at least 90°. Alternatively, it is conceivable for the control element 26*c* to be mounted so as to be rotatable by at least 180° or at least 360°.

The control unit 24*c* also has a control housing element 110*c*. The control housing element 110*c* has an at least substantially cylindrical outer contour. The control housing element 110*c* is designed to encompass and/or guide the control element 26*c*, at least partly, during operation by an operator. Advantageously, the control housing element 110*c* is made, at least substantially, from metal. Alternatively or additionally, the control housing element 110*c* may be made from plastic and/or from a material considered appropriated by persons skilled in the art.

The control housing element 110*c* also has at least one recess 112*c*. The recess 112*c* is designed, at least, to guide the control element 26*c*. The recess 112*c* realizes, in particular, a coulisse for guiding the control element 26*c*.

The control unit 24*c* comprises a control gear unit 30*c*. The control gear unit 30*c* is arranged within the control housing element 110*c*. The control gear unit 30*c* is connected, at least partly, by non-positive and/or positive engagement to the control element 26*c*. Advantageously, the control gear unit 30*c* is realized, at least partly, as a cam gear unit. The control gear unit 30*c* has a first cam gear element 136*c*. The first cam gear element 136*c* is preferably realized as a full cylinder. Preferably, an outer contour of the first cam gear element 136*c* corresponds to an inner contour of the control housing element 110*c*. The first cam gear element 136*c* has a threaded slot cutout (not shown here) along the cylindrical outer contour. Advantageously, the threaded slot cutout is realized in a circumferential region of the control gear unit 30*c* that corresponds to a maximum rotational movement of the control element 26*c*. Advantageously, the slot cutout is arranged in a circumferential region of the first cam gear element 136*c* that corresponds to a circumferential angle of at least 90°. The control gear unit 30*c* also has a second cam gear element (not shown here). The second cam gear element is designed to be guided with positive engagement in the slot cutout. The second cam gear element may be realized as a guide pin, as a guide bolt, as a guide tooth, as a guide projection and/or as a second cam gear element considered appropriated by persons skilled in the art. The control gear unit 30*c* is mounted so as to be rotatable about the movement axis 28*c* of the control element 26*c*. The control gear unit 30*c* is connected, at least partly, by non-positive and/or positive engagement to the control element 26*c*. A rotational movement of the control element 26*c* about the movement axis 28*c* effects a pivot movement of the control gear unit 30*c* about the movement axis 28*c* of the control element 26*c*. A rotational movement of the control element 26*c* about the movement axis 28*c* also effects a translational movement of the control gear unit 30*c* parallel to the movement axis 18*c* of the clamping unit (see FIG. 1*b*).

The control unit 24*c* also has at least one conversion element 32*c*. The conversion element 32*c* is arranged within the control housing element 110*c*. The conversion element 32*c* is arranged so as to be pivotable about the movement axis 28*c*. Advantageously, the conversion element 32*c* is mounted so as to be pivotable by at least 90° about the movement axis 28*c*. Preferably, an outer contour of the conversion element 32*c* corresponds to an inner contour of the control housing element 110*c*. Advantageously, the conversion element 32*c* is realized with non-positive and/or positive engagement with the control element 26*c*. Preferably, the conversion element 32*c* is realized so as to be at least partly integral with the control element 26*c*. Preferably, the conversion element 32*c* is realized with non-positive and/or positive engagement with the first cam gear element 136*c*. Advantageously, the conversion element 32*c* is realized so as to be at least partly integral with the first cam gear element 136*c*. Particularly advantageously, the conversion element 32*c* is realized by the first cam gear element 136*c*. The conversion element 32*c* is designed to convert a pivot movement of the control element 26*c* about the movement axis 28*c* of the control element 26*c* into a translational movement of the control element 26*c* along the movement axis 28*c* of the control element 26*c*.

The quick-change clamping device 10*c* additionally comprises a holding unit 46*c*. The holding unit 46*c* is arranged within the control housing element 110*c*. The holding unit 46*c* is designed to fix a position, in particular a control position, of the control element 26*c*. In particular, the holding unit 46*c* is designed to fix a release position and/or a clamping position of the clamping unit. The holding unit 46*c* comprises at least one holding element (not shown here). The holding element is realized as a latching element. The holding element may be realized, for example as a latching lug and/or as a pin that be realized a latching connection to a corresponding latching recess and/or latching depression, for example at an end of the threaded slot cutout of the control gear unit 30*c*. The holding unit 46*c* also comprises at least one holding spring element 54*c*. The holding spring element 54*c* is advantageously realized as a resilient element. Preferably, the holding spring element 54*c* is realized as a spiral restoring spring. The holding spring element 54*c* has two ends, which are connected at least by non-positive and/or positive engagement to the control unit 24*c*. Preferably, the holding spring element 54*c* is arranged between the control element 26*c* and at least one surface of the transmission housing unit 58*c*. The holding spring element 54*c* encompasses the control gear unit 30*c*, advantageously to a large extent. The holding spring element 54*c* is designed to apply a spring force to the control element in at least one operating state, in particular in a release position of the clamping unit. The holding spring element 54*c* is designed to apply a spring force to the holding element. The holding spring element 54*c* is designed to apply a spring force to the control element 26*c* in at least one operating state, in particular in a release position of the clamping unit, in particular a spring force that forces the control element 26*c* in the direction of a clamping position.

Figure 4:
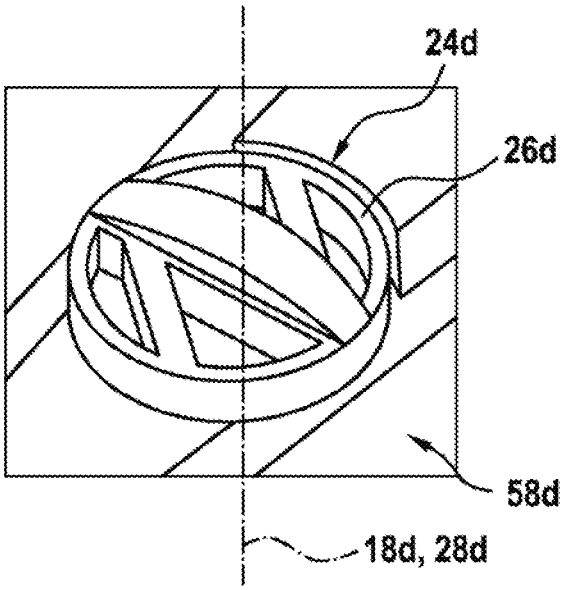

FIG. 4 shows a control unit 24*d* having the control element 26*d*, in a perspective representation. The control element 26*d* is realized as a twist switch. Alternatively, the control element 26*d* may be realized as a rotary button and/or rotary knob. The control element 26*d* is arranged on an exterior of the transmission housing unit 58*d*. The control element 26*d* has a movement axis 28*d*. The movement axis 28*d* of the control element 26*d* is at least substantially parallel to a movement axis 18*d* of a clamping unit (see FIG. 1*b*), not shown here. The movement axis 28*d* is realized as a rotation axis. The control element 26*d* is mounted so as to be rotatable about the movement axis 28*d*. Advantageously, the control element 26*d* has a at least one contact element (not shown here). The contact element is designed, upon a rotational movement of the control element 26*d* about the movement axis 28*d* of the control element 26*d*, to contact an actuating element, not shown here, of the control unit 24*d*, in a contact region, not shown here, for the purpose of transmitting an operator force to the actuating element. The contact element is designed, by means of transmission of the operator force, to effect a translational movement of the actuating element along the movement axis 28*d* of the control element 26*d*, and in particular along the movement axis 18*d* of the clamping unit. To realize the contact region, the contact element may have, for example, a wedge-shaped and/or at least partly rounded contour, and/or a contour considered appropriated by persons skilled in the art.

Figure 5:
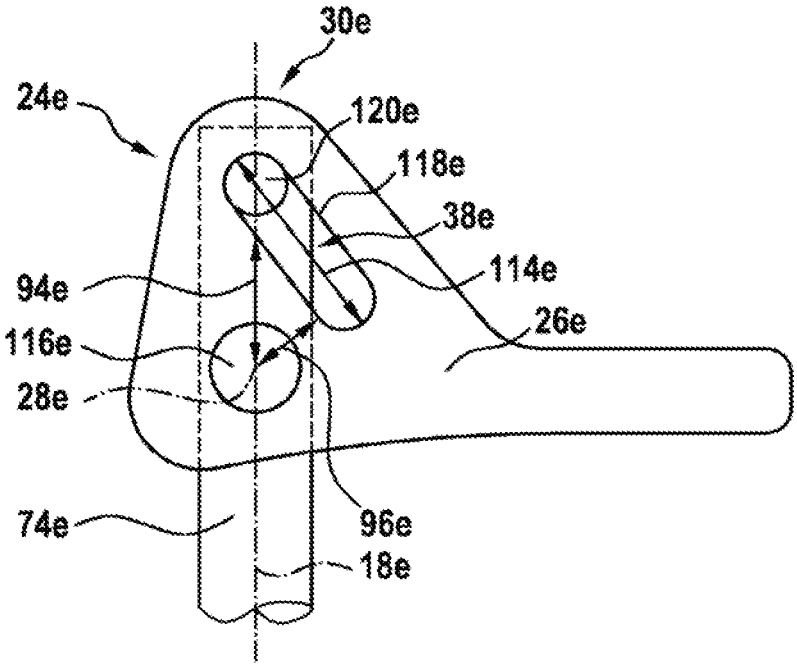
FIG. 5 shows a further exemplary embodiment of a control unit according to the disclosure, having a control element, realized as a pivoted lever, having a toggle gear unit, in a highly simplified detail view, from the side.

FIG. 5 shows a control element 26*e* of a control unit 24*e* in a highly simplified detail representation, from the side. The control element 26*e* is realized substantially as a pivoted lever. The control element 26*e* is mounted so as to be rotatable about a movement axis 28*e*. The control unit 24*e* has a pivot joint 116*e* of the control element 26*e*. The control element 26*e* is mounted, by means of the pivot joint 116*e*, so as to be rotatable about a movement axis 28*e*. The movement axis 28*e* is substantially perpendicular to a movement axis 18*e* of a clamping unit (see FIG. 1*b*), not shown here. The control element 26*e* is mounted to as to be rotatable relative to a transmission housing unit (not shown here). The movement axis 28*e* is fixed in position relative to a transmission housing unit. The control unit 24*e* also has at least one actuating element 74*e*. The control element 26*e* is mounted so as to be rotatable relative to the actuating element 74*e*, about the movement axis 28*e*. The actuating element 74*e* is designed to move translationally along the movement axis 18*e* of the clamping unit (see FIG. 1*b*). The actuating element 74*e* is mounted so as to be translationally movable relative to the movement axis 28*e*.

The control unit 24*e* also has a control gear unit 30*e*. The control gear unit 30*e* is realized as a toggle gear unit. The control gear unit 30*e* has at least one first toggle gear element 118*e*. The first toggle gear element 118*e* is realized as a coulisse guide. The first toggle gear element 118*e* is realized in a contact region 38*e* of the control element 26*e*. The first toggle gear element 118*e* has a substantially linear shape. The first toggle gear element 118*e* has a direction of longitudinal extent 114*e*. Alternatively, the first toggle gear element 118*e* may be curved and/or have a circular path, and an end region of the first toggle gear element 118*e* may also be inclined relative to the first toggle gear element 118*e*, for example in order to realize fixing of the toggle gear unit. The first toggle gear element 118*e* is realized in the control element 26*e* in such a manner that, along the direction of longitudinal extent 114*e*, a first distance 94*e* of a first end of the first toggle gear element 118*e* from the movement axis 28*e* differs from a second distance 96*e* of a second end of the first toggle gear element 118*e*, which faces away from the first end, from the movement axis 28*e*.

The control gear unit 30*e* has a second toggle gear element 120*e*. The second toggle gear element 120*e* is realized as a guide pin. The second toggle gear element 120*e* is realized so as to correspond to the first toggle gear element 118*e*. The second toggle gear element 120*e* is at least substantially parallel to the movement axis 28*e* of the control element 26*e*. The second toggle gear element 120*e* is aligned at least substantially perpendicularly in relation to the movement axis 18*e* of the clamping unit. The second toggle gear element 120*e* is inserted, at least partly, in the first toggle gear element 118*e*. The second toggle gear element 120*e* is designed for positive-engagement connection to the first toggle gear element 118*e*. The second toggle gear element 120*e* is designed, upon being moved by means of an operator force, to be guided within the first toggle gear element 118*e*. The control gear unit 30*e* may also have at least one further toggle gear element.

When an operator force is applied for the purpose of executing a rotational movement of the control unit 24*e* about the movement axis 28*e*, the second toggle gear element 120*e* is guided in the first toggle gear element 118*e*. A rotational movement of the control element 26*e* causes the first toggle gear element 118*e* to move relative to the second toggle gear element 120*e*. Consequently, a rotational movement of the control element 26*e* effects a translational movement of the actuating element 74*e* parallel to the movement axis 18*e* of the clamping unit (see FIG. 1*b*).

Figure 6:
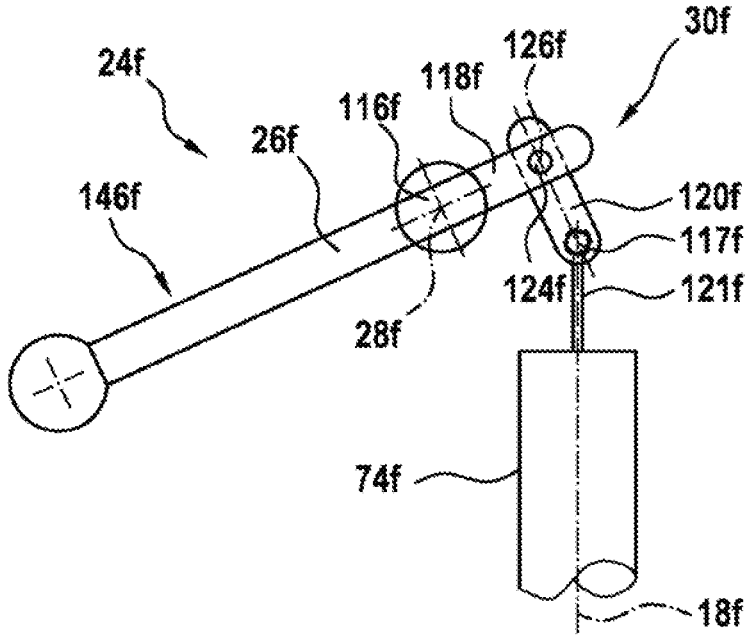
FIG. 6 shows a further exemplary embodiment of a control unit according to the disclosure, having a control element, realized as a pivoted lever, having a further exemplary embodiment of a toggle gear unit, in a highly simplified detail view, from the side, FIG. 7 a further exemplary embodiment of a control unit according to the disclosure, having a control element, realized as a pivoted lever, having a rack-and-pinion gear unit, in a highly simplified detail view, from the side, FIG. 8 a further exemplary embodiment of a control unit according to the disclosure, having a control element, realized as a pivoted lever, having a cam gear unit, in a highly simplified detail view, from the side, FIG. 9 a further exemplary embodiment of a control unit according to the disclosure, having a control element, realized as a sliding switching element, in a perspective detail representation, FIG. 10 a further exemplary embodiment of a control unit according to the disclosure, having a control element that has an inclined plane, in a schematic detail representation, FIG. 11 a further exemplary embodiment of a control unit according to the disclosure, having a control element realized as a pushbutton, in a detail view from the side, FIG. 12 a further exemplary embodiment of a control unit according to the disclosure, having a control element realized as a push-lever, in a detail view from the side, FIG. 13 a further exemplary embodiment of a control unit according to the disclosure, having a control element realized as a pivoted lever, in a detail view from the side, FIG. 14 a further exemplary embodiment of a control unit according to the disclosure, having a control element realized as a pull link, in a detail view from the side, FIG. 15 a holding unit of a quick-change clamping device according to the disclosure, in a detail view from the side, FIG. 16 a further exemplary embodiment of a holding unit, having a magnetic element, in a perspective representation, FIG. 17 a further exemplary embodiment of a holding unit, having a catch-on lever, in a perspective representation, and FIG. 18 a damping unit, realized as a wrap spring unit, in a perspective view from the side.

FIG. 6 shows a control element 26*f* of a control unit 24*f* in a highly simplified detail representation, from the side. The control element 26*f* is mounted so as to be rotatable about a pivot joint 116*f*. The control element 26*f* is mounted so as to be rotatable about a movement axis 28*f*. The movement axis 28*f* is at least substantially perpendicular to a movement axis 18*f* of a clamping unit (see FIG. 1*b*), not shown here. The control unit 24*f* also comprises at least one control gear unit 30*f*. The control gear unit 30*f* is realized as a toggle gear unit. The control gear unit 30*f* has a first toggle gear element 118*f*. The first toggle gear element 118*f* is realized so as to be integral with control element 26*f*. The first toggle gear element 118*f* is arranged on a side of the pivot joint 116*f* that faces away from a control region 146*f* of the control element 26*f*. The control gear unit 30*f* also has a second toggle gear element 120*f*. The second toggle gear element 120*f* is mounted so as to be rotatable about a further pivot joint 124*f* of the control gear unit 30*f*. The second toggle gear element 120*f* is mounted so as to be rotatable about the further pivot joint 124*f*, relative to the first toggle gear element 118*f*. The further pivot joint 124*f* defines a movement axis 126*f* of the second toggle gear element 120*f*. The movement axis 126*f* of the second toggle gear element 120*f* is at least substantially parallel to the movement axis 28*f* of the control element 26*f*. The control unit 24*f* also has an actuating element 74*f*. The control unit 24*f* has a connection element 121*f*, which is connected at least by non-positive and/or positive engagement to the actuating element 74*f*. The connection element 121*f* is aligned along the movement axis 18*f* of the clamping unit. The connection element 121*f* is realized as a connection bolt and/or as a connection element 121*f* considered appropriated by persons skilled in the art. The second toggle gear element 120*f* is connected to the connection element 121*f* so as to be rotatable about an additional pivot joint 117*f* of the control gear unit 30*f*. The control gear unit 30*f* is designed to transmit an operator force, in particular a torque, exerted upon the control element 26*f* to the actuating element 74*f* of the control unit 24*f*, and to cause the actuating element 74*f* to move along the movement axis 18*f* of the clamping unit.

Figure 7:
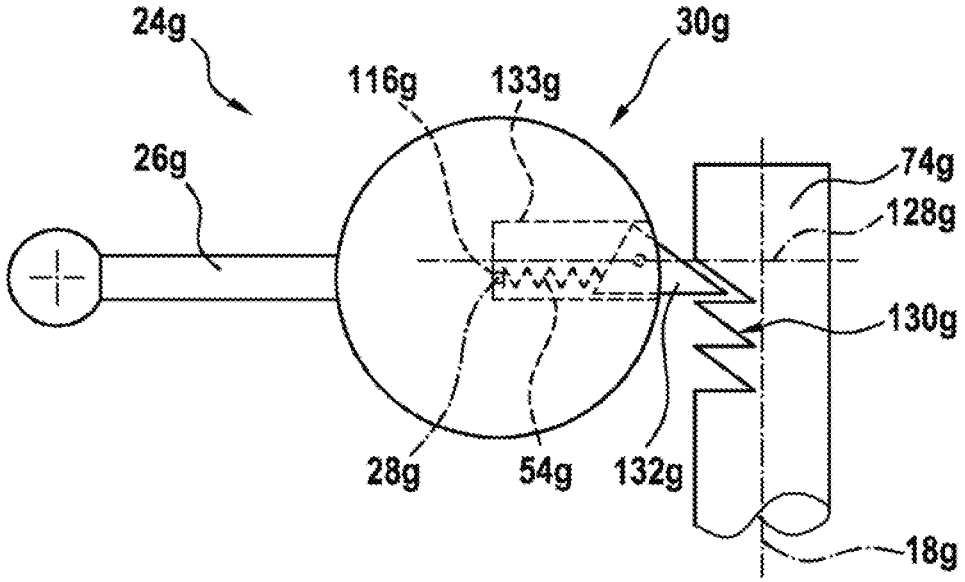

FIG. 7 shows the control element 26*g* of the control unit 24*g* in a highly simplified detail representation, from the side. The control element 26*g* is mounted so as to be rotatable about a movement axis 28*g*. The control unit 24*g* has an actuating element 74*g*. In particular, the control element 26*g* is at least to a large extent arranged in an offset manner relative to the actuating element 74*g*, in a direction perpendicular to the movement axis 28*g*. The movement axis 28*g* of the control element 26*g* is at least substantially perpendicular to a movement axis 18*g* of a clamping unit (see FIG. 1*b*), not shown here.

The control unit 24*g* has a control gear unit 30*g*. The control gear unit 30*g* is realized as a rack-and-pinion gear unit. The control gear unit 30*g* has a first rack-and-pinion gear element 130*g*. The first rack-and-pinion gear element 130*g* has at least one tooth cutout. The first rack-and-pinion gear element 130*g* advantageously has a plurality of tooth cutouts. Advantageously, the first rack-and-pinion gear element 130*g* is arranged on the actuating element 74*g* of the control unit 24*g*. Preferably, the first rack-and-pinion gear element 130*g* is realized so as to be integral with the actuating element 74*g*. The control gear unit 30*g* also has a second rack-and-pinion gear element 132*g*. The second rack-and-pinion gear element 132*g* is realized as a tooth.

The second rack-and-pinion gear element 132*g* is made, at least partly, from metal. Alternatively or additionally, the second rack-and-pinion gear element 132*g* may also be realized as a serration and/or as a pin and/or as a second rack-and-pinion gear element 132*g* considered appropriated by persons skilled in the art. Moreover, the second rack-and-pinion gear element 132*g* may additionally be made, at least partly, from plastic, and/or from a material considered appropriated by persons skilled in the art. The second rack-and-pinion gear element 132*g* has an outer contour that corresponds, at least partly, to a tooth cutout of the first rack-and-pinion gear element 130*g*. The second rack-and-pinion gear element 132*g* is realized as a pawl, in particular as a locking pawl. The second rack-and-pinion gear element 132*g* is mounted so as to be translationally movable in a guide recess 133*g* of the control unit 24*g*. The second rack-and-pinion gear element 132*g* is mounted so as to be translationally movable along a translation axis 128*g*. The translation axis 128*g* is aligned at least substantially perpendicularly in relation to the movement axis 28*g*. In at least one operating state, the translation axis 128*g* is aligned at least substantially perpendicularly in relation to the movement axis 18*g* of the clamping unit. The second rack-and-pinion gear element 132*g* is resiliently mounted, by means of a spring element, on a pivot joint 116*g* of the control element 26*g*. In particular, the second rack-and-pinion gear element 132*g* is designed, in at least one operating state, in particular for the purpose of realizing a release position of the clamping unit, to realize a non-positive and/or positive engagement connection to the first rack-and-pinion gear element 130*g*, in particular to at least one tooth cutout of the plurality of tooth cutouts, for the purpose of transmitting force to the actuating element 74*g*. In particular, the control element 26*g* is designed, by means of a rotational movement exerted as a result of an operator force, to transmit the operator force, at least partly, from the second rack-and-pinion gear element 132*g* to the actuating element 74*g*. In addition, a control gear unit 30*g* may have additional second rack-and-pinion gear elements 132*g* that are offset in relation to the second rack-and-pinion gear element 132*g* in the direction of rotation of the control element 26*g*. Alternatively, it is conceivable for the second rack-and-pinion gear element 130*g* to be connected at least by non-positive and/or positive engagement to the actuating element 74*g*, and the first rack-and-pinion gear element 132*g* to be connected by non-positive and/or positive engagement to the control element 26*g*.

Figure 8:
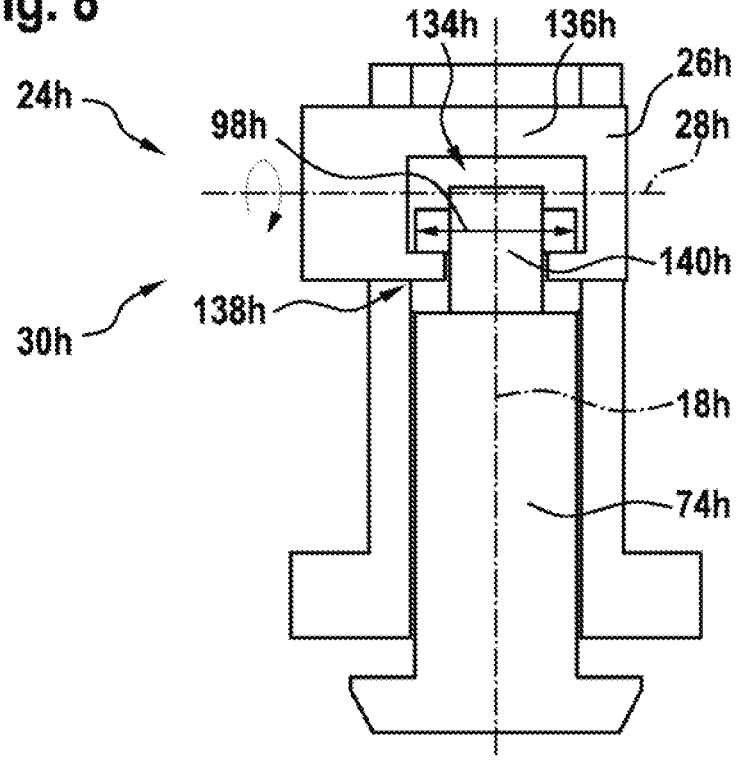

FIG. 8 shows the control element 26*h* of the control unit 24*h* in a highly simplified detail representation, from the side. The control element 26*h* is mounted so as to be rotatable about a movement axis 28*h*. The control element 26*h* is realized, at least largely, as a cylindrical body. The movement axis 28*h* is at least substantially perpendicular to a movement axis 18*h* of a clamping unit (see FIG. 1*b*), not shown here. The control unit 24*h* has at least one control gear unit 30*h*. In particular, the control gear unit 30*h* is realized, at least partly, so as to be integral with the control element 26*h*. Advantageously, the control gear unit 30*h* is realized, at least partly, by the control element 26*h*. The control gear unit 30*h* is realized, at least partly, as a cam gear unit. In particular, the control gear unit 30*h* comprises at least one first cam gear element 136*h*. The first cam gear element 136*h* is realized as a cylinder body. Preferably, the first cam gear element 136*h* is made from metal. Alternatively or additionally, the first cam gear element 136*h* may be made from a plastic and/or from another material considered appropriated by persons skilled in the art. The first cam gear element 136*h* is realized, at least partly, as a hollow body, having a substantially cylindrical cavity 134*h*. The cavity 134*h* is arranged, at least partly, asymmetrically in relation to the movement axis 28*h*. Preferably, a wall thickness of the cavity 134*h* is realized asymmetrically in relation to the movement axis 28*h* of the control element 26*h*. The first cam gear element 136*h* has at least one slot cutout 138*h*. The slot cutout 138*h* is realized as a cutout along the circumference of the first cam gear element 136*h*. The slot cutout 138*h* is realized as cutout extending through from an outer region of the first cam gear element 136*h* into the cavity 134*h*. Advantageously, the slot cutout 138*h* is realized along the circumference, at a circumferential angle of, advantageously, at least 90°, and particularly preferably of at least 180°.

The control gear unit 30*h* also has a second cam gear element 140*h*. The second cam gear element 140*h* is arranged at least at an end of the actuating element 74*h* of the control element 26*h* that faces toward the control element 26*h*. The second cam gear element 140*h* is connected by non-positive and/or positive engagement to the actuating element 74*h*. The second cam gear element 140*h* is realized, at least partly, as a cross bar. The second cam gear element 140*h* is realized so to be at least partly integral with the actuating element 74*h*.

The second cam gear element 140*h* has at least one longitudinal extent 98*h* that is at least substantially perpendicular relative to a direction of main extent of the actuating element 74*h*. The longitudinal extent 98*h* of the second cam gear element 140*h* is at least substantially parallel to the movement axis 28*h* of the control element 26*h*. The longitudinal extent 98*h* of the second cam gear element 140*h* is greater than an extent of the slot cutout 138*h* in a direction parallel to the movement axis 28*h* of the control element 26*h*. When the control unit 24*h* is in an assembled state, the second cam gear element 140*h* is arranged, at least partly, within the cavity 134*h* of the first cam gear element 136*h*. The second cam gear element 140*h* is connected by positive engagement and captively to the first cam gear element 136*h*. The actuating element 74*h* is routed through the slot cutout 138*h*. The actuating element 74*h* is movably mounted within the slot cutout 138*h*. A rotational movement of the control element 26*h* and/or of the first cam gear element 136*h* causes the cavity 134*h* of the first cam gear element 136*h* to be distributed asymmetrically in relation to the movement axis 28*h* of the control element 26*h*, and consequently causes a translational movement of the second cam gear element 140*h* and/or of the actuating element 74*h* that is substantially parallel to a movement axis 18*h* of the clamping unit (see FIG. 1*b*).

Figure 9:
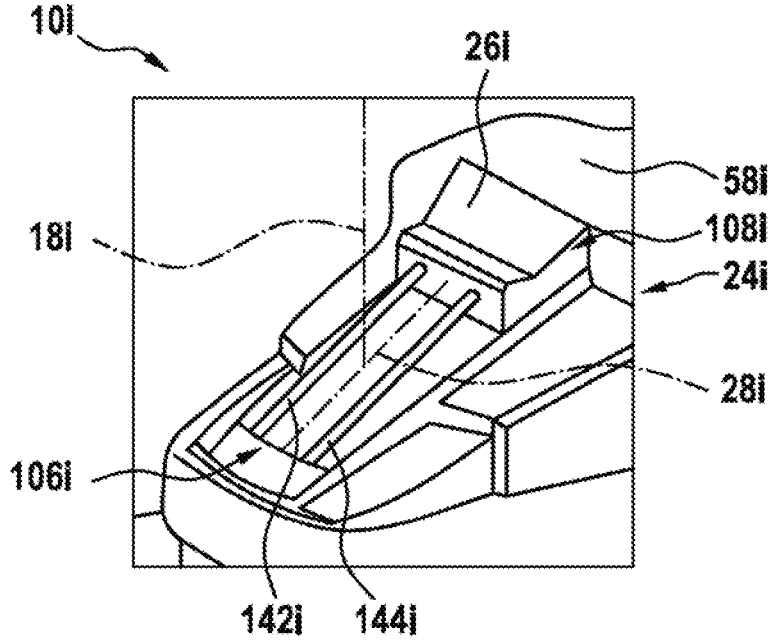

FIG. 9 shows a control unit 24*i* of a quick-change clamping device 10*i* in a highly simplified, perspective detail representation. The control unit 24*i* has at least one control element 26*i*. The control element 26*i* is realized as a sliding switching element. In particular, the control element 26*i* has at least two switch positions 106*i*, 108*i*, the control element 26*i* being mounted such that it can slide between them. In particular, the control element 26*i* is translationally mounted, by means of at least one first guide element 142*i*. Advantageously, the control element 26*i* is additionally mounted in a translationally slidable manner, by means of at least one second guide element 144*i*. In particular, the control element 26*i* is mounted so as to be translationally movable along a movement axis 28*i*. The movement axis 28*i* is at least substantially perpendicular to a movement axis 18*i* of a clamping unit (see FIG. 1*b*), not shown here. In particular, the movement axis 28*i* has at least one vector component that is at least substantially perpendicular to the movement axis 18*i* of the clamping unit. The control element 26*i* is arranged, at least partly, on an exterior of a transmission housing unit 58*i* of a portable power tool (not denoted here by a reference), only a portion of which is shown here. The control element 26*i* is arranged on an exterior of the transmission housing unit 58*i*.

Advantageously, the control unit 24*i* has at least one contact element, not shown here, that is connected at least by non-positive and/or positive engagement to the control element 26*i*. The contact element is advantageously made from metal. The contact element is advantageously arranged in an inner region of the transmission housing unit 58*i*. Alternatively, the contact element may be arranged, at least partly, on an exterior of the transmission housing unit 58*i*, and made from a plastic and/or from another material considered appropriated by persons skilled in the art. It is also conceivable for the contact element to be at least partly integrally connected to the control element 26*i*. The contact element is designed, in at least one operating state of the quick-change clamping device 10*i*, to transmit a sliding force, exerted upon the control element 26*i*, to an actuating element in contact with the contact element. It is conceivable for a contact element to be realized as a wedge element, to act in combination with a toggle unit, and/or to be realized as a contact element, considered appropriated by persons skilled in the art, for a control element 26*i* realized as a sliding switching element.

Figure 10:
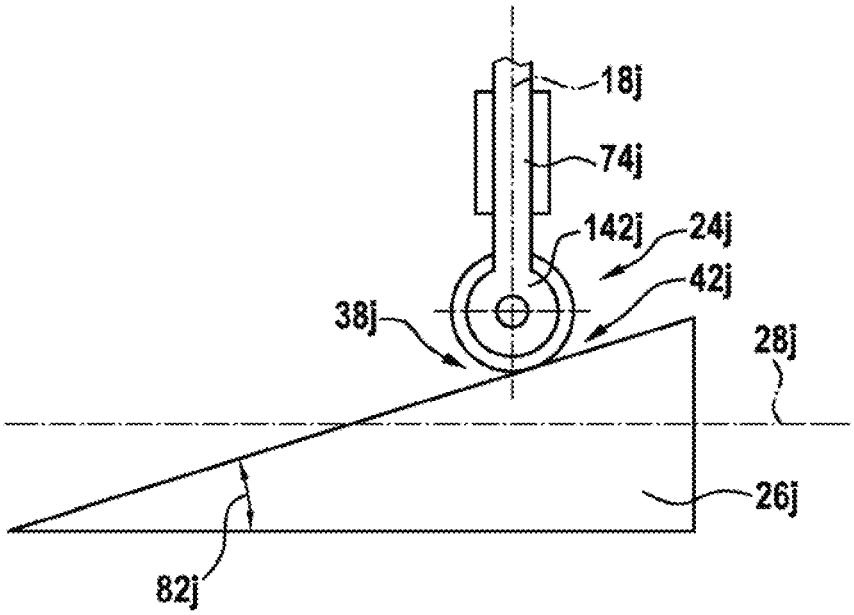

FIG. 10 shows the control unit 24*j* in a highly simplified, enlarged detail representation. The control unit 24*j* has a control element 26*j*. The control element 26*j* is realized as an inclined plane. The control element 26*j* has at least one movement axis 28*j*, which is aligned at least substantially perpendicularly in relation to a movement axis 18*j* of a clamping unit (see FIG. 1*b*), not shown here. The control element 26*j* realizes at least one actuating region 42*j*. The actuating region 42*j* realizes a plane that, at least in part, is inclined in relation to the movement axis 28*j* of the control element 26*j*. In particular, the plane of the actuating region 42*j* of the control element 26*j* includes an at least substantially acute angle 82*j* with the movement axis 28*j* of the control element 26*j*. The control unit 24*j* also has an actuating element 74*j*. The actuating element 74*j* has a guide element 142*j*, at least at an end that faces toward the control element 26*j*. Advantageously, the guide element 142*j* is movably mounted, at least partly. For example, the guide element 142*j* may be realized as a rolling cylinder, a rolling wheel, a sphere, and/or as a guide element 142*j* considered appropriated by persons skilled in the art. Moreover, it is conceivable for the guide element 142*j* to be made of a material having an at least largely frictionless surface. In particular, the control element 26*j* is designed to realize, on a side of the actuating element 74*j* that faces toward the clamping unit, at least one contact region 38*j*, in which the guide element 142*j*, with the actuating region 42*j*, is designed to transmit an actuating force and/or operator force to the clamping unit. In particular, the control element 26*j* is designed to move the clamping unit into the release position for the purpose of realizing a contact region 38*j* between the guide element 142*j* and the actuating region 42*j*. In particular, the control element 26*j* is designed to transmit an actuating force along the movement axis 28*j* of the control element 26*j*, to the actuating element 74*j*. By means of the transmission of the operator force to the actuating element 74*j*, a movement of the control element 26*j* in the movement axis 28*j* consequently causes a movement of the actuating element 74*j* along the movement axis 18*j* of the clamping unit. In particular, when the clamping unit is in a clamping position (see FIG. 1), formation of the contact region 38*j* between the actuating element 74*j* and the control element 26*j* is at least substantially prevented.

Figure 11:
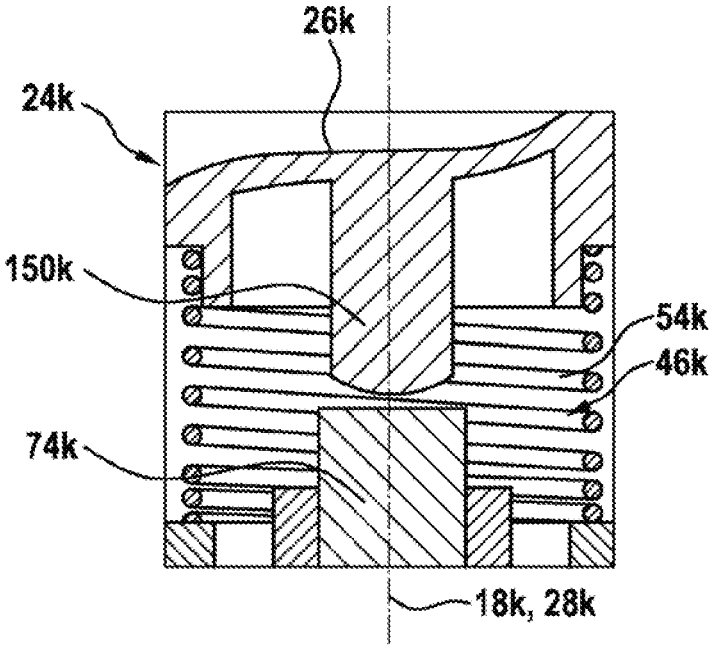

FIG. 11 shows a control element 26*k* of a control unit 24*k* in a highly simplified detail representation, from the side. The control element 26*k* is realized as a pushbutton. The control element 26*k* is arranged, at least partly, on an exterior of a transmission housing unit, not shown here. The control element 26*k* is also partly arranged in an inner region of the transmission housing unit. The control element 26*k* has a movement axis 28*k*, which runs at least substantially parallel to a movement axis 18*k* of a clamping unit (see FIG. 1*b*), not shown here. The control element 26*k* is designed to transmit an operator force, in particular a pressure force, exerted upon the control element 26*k* by an operator at least substantially along the movement axis 18*k* of the clamping unit, to an actuating element 74*k* of the control unit 24*k*. The operating element 26*k* advantageously has at least one contact bolt 150*k*, which is arranged, at least largely, in an inner region of the transmission housing unit. The contact bolt 150*k* is preferably realized, at least partly, as a cylinder having an at least substantially round cross section, and has an at least partly rounded end, for the purpose of realizing a contact surface with the actuating element 74*k*. Alternatively or additionally, the contact bolt 150*k* may have a rectangular or polygonal cross section, and/or a cross section considered appropriated by persons skilled in the art. The contact bolt 150*k* is preferably made from plastic. Alternatively or additionally, the contact bolt 150*k* may also be made from metal and/or from a material considered appropriated by persons skilled in the art. The contact bolt 150*k* is connected at least by non-positive and/or positive engagement, and preferably at least partly integrally, to the control element 26*k*. Advantageously, the contact bolt 150*k* is designed, at least in an operating state, to be in contact with the actuating element 74*k* for the purpose of bringing the clamping unit from the clamping position into the release position. The contact bolt 150*k* is designed to transmit an operator force to the actuating element 74*k* of the control unit 24*k* and/or the clamping unit. Advantageously, for the purpose of providing a restoring force, at least the contact bolt 150*k* is resiliently mounted, by means of a holding unit 46*k* that comprises at least one holding spring element 54*k*.

Figure 12:
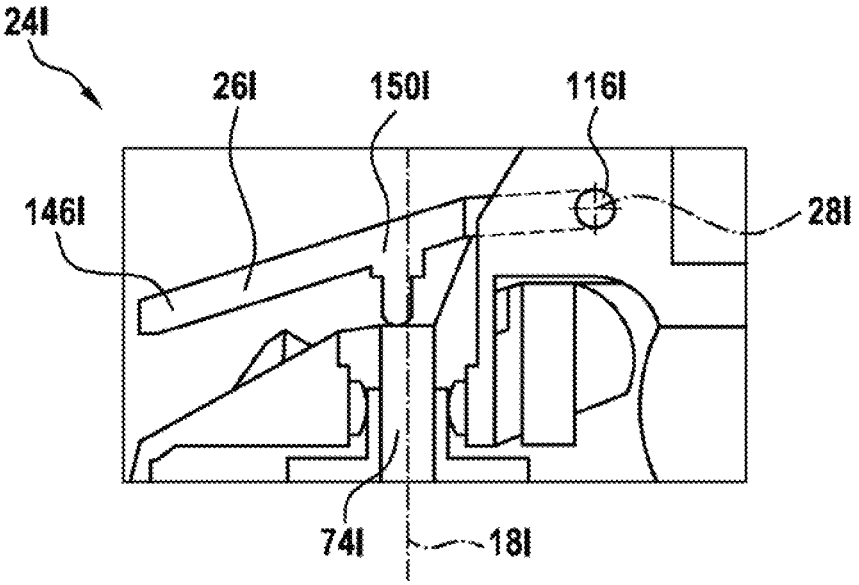

FIG. 12 shows a control element 26*l*, according to the invention, of a control unit 24*l* according to the invention, in a simplified detail representation, from the side. The control element 26*l* is realized as a push-lever. In particular, the control element 26*l* is mounted so as to be rotatable about a pivot joint 116*l*. The control element 26*l* is mounted so as to be rotatable about a movement axis 28*l*. The movement axis 28*l* is at least substantially perpendicular to a movement axis 18*l* of a clamping unit (see FIG. 1*b*), not shown here. The control element 26*l* has a contact bolt 150*l*, arranged eccentrically in relation to the movement axis 28*l*. The contact bolt 150*l* is arranged, along a longitudinal extent, between the pivot joint 116*l* and a control region 1461 of the control element 26*l*. The contact bolt 150*l* is designed to contact an actuating element 74*l* of the control unit 24*l* for the purpose of transmitting an operator force. It is conceivable for the control unit 24*l* to have at least one holding unit that, by means of a holding spring element, exerts a restoring force upon the control element 26*l*. Alternatively or additionally, it is conceivable for the control unit 24*l* to have a restoring spring element that acts in combination with the pivot joint 116*l* and exerts a restoring force upon the pivot joint 116*l* and/or upon the control element 26*l*.

Figure 13:
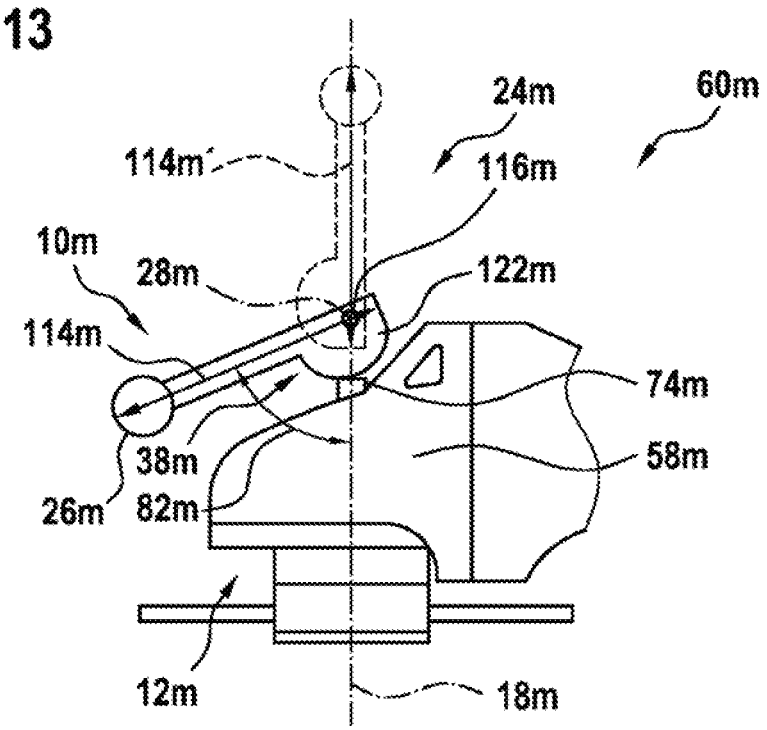

FIG. 13 shows a quick-change clamping device 10*m* having an control unit 24*m* that comprises a control element 26*m* in a highly simplified detail representation, from the side. The control element 26*m* is realized as a pivoted lever. The control element 26*m* is arranged, at least largely, on an exterior of a transmission housing unit 58*m* of a portable power tool 60*m*. The control element 26*m* is mounted so as to be pivotable about a pivot joint 116*m*. The control element 26*m* is mounted so as to be pivotable about a movement axis 28*m*. The movement axis 28*m* of the control element 26*m* is aligned at least substantially perpendicularly in relation to a movement axis 18*m* of a clamping unit 12*m*. The pivot joint 116*m* of the control element 26*m* is arranged, along the movement axis 18*m* of the clamping unit 12*m*, in a vertically offset manner in relation to an actuating element 74*m* of the control unit 24*m*. The movement axis 28*m* of the control element 26*m* intersects the movement axis 18*m* of the clamping unit 121. Alternatively, the movement axis 28*m* of the control element 26*m* may be arranged in an offset manner in relation to the movement axis 18*m* of the clamping unit 12*m*, in a direction perpendicular to the movement axis 18*m* of the clamping unit 12*m*.

The control element 26*m* has a projection 122*m*. The projection 122*m* is semi-cylindrical, and realizes an outer contour of half of a cylinder surface. The projection 122*m* realizes a contact region 38*m*, in which the projection 122*m* can be brought into contact with an actuating element 74*m* of the control unit 24*m*. The pivot joint 116*m* is arranged in the region of the projection 122*m* of the control element 26*m*. The pivot joint 116*m* is arranged eccentrically in the projection 122*m*. Alternatively, it is possible to dispense with a projection 122*m*, in which case the control element 26*m* may, at least partly, may have the shape of a linear and/or curved rod. A pivot movement of the control element 26*m*, about the movement axis 28*m* of the control element 26*m*, that results from an operator force realizes an operating state in which the control element 26*m* contacts the actuating element 74*m* and transmits the operator force to the actuating element 74*m* for the purpose of realizing a release position of the clamping unit 12*m*. For the purpose of realizing the release position of the clamping unit 12*m*, a direction of longitudinal extent 114*m* of the control element 26*m* is realized so as to be substantially parallel to a surface of the transmission housing unit 58*m*. For the purpose of realizing the release position of the clamping unit 12*m*, the direction of longitudinal extent 114*m* of the control element 26*m* includes an at least substantially acute angle 82*m* with the movement axis 18*m* of the clamping unit 12*m*. Alternatively, for the purpose of realizing the release position of the clamping unit 12*m*, the direction of longitudinal extent 114*m* of the control element 26*m* may be aligned perpendicularly in relation to the movement axis 18*m* of the clamping unit 12*m*, and/or at least partly obliquely in relation to the surface of the transmission housing unit 58*m*.

When the clamping unit 12*m* is in a clamping position, the control element 26*m* is advantageously not in contact with the actuating element 74*m*. In the clamping position, the control element 26*m* is inclined relative to a position of the operating element 26*m* of the release position of the clamping unit 12*m* about the movement axis 28*m* of the operating element 26*m*. For the purpose of realizing the clamping position, a direction of longitudinal extent 114*l*' of the control element 26*m* is advantageously aligned at least substantially parallel to the movement axis 18*m* of the clamping unit 12*m*. Advantageously, when the clamping unit 12*m* is in the clamping position, the direction of longitudinal extent 114*m*' includes an at least substantially obtuse angle 82*m* with the direction of longitudinal extent 114*m* in the release position of the clamping unit 12*m*. Alternatively, in the clamping position, the direction of longitudinal extent 114*m*' may include an at least substantially obtuse angle 82*m* or an at least substantially acute angle 82*m* with the movement axis 18*m* of the clamping unit 12*m*.

Figure 14:
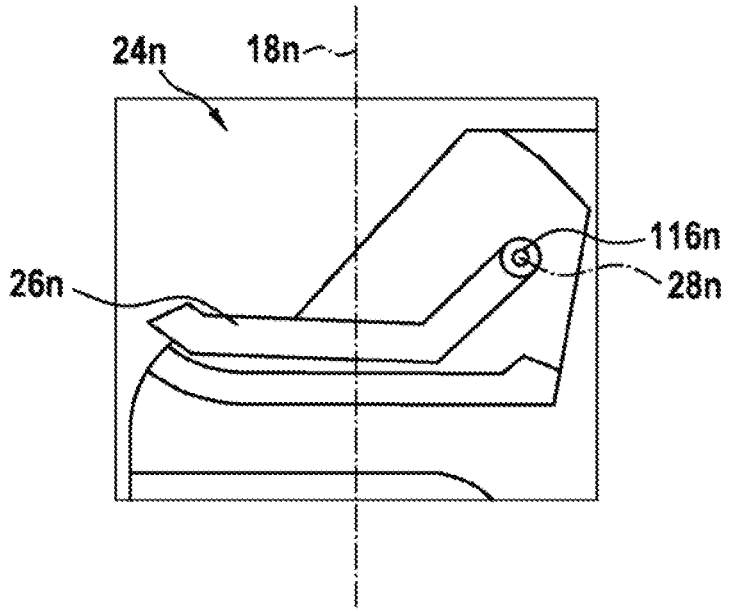

FIG. 14 shows a control unit 24*n* having a control element 26*n* in a highly simplified detail representation, from the side. The control element 26*n* is realized as a pull link. The control element 26*n* has at least one pivot joint 116*n*, is mounted so as to be pivotable about a pivot joint 116*n*. The control element 26*n* is mounted so as to be pivotable about a movement axis 28*n*. The movement axis 28*n* of the control element 26*n* is aligned at least substantially perpendicularly in relation to a movement axis 18*n* of a clamping unit (see FIG. 1*b*), not shown here. In particular, an application of force exerted by an operator force in a direction parallel to the movement axis 18*n* of the clamping unit causes the control element 26*n* to move in a direction away from an actuating element, not shown here, a realization of a release position of the clamping unit. Alternatively, the control element 26*n* may be realized as a pull lever, which is mounted to as to be rotatable about a pivot joint 116*n*, and which is designed to realize the release position of the clamping unit by means of a tensile force.

Figure 15:
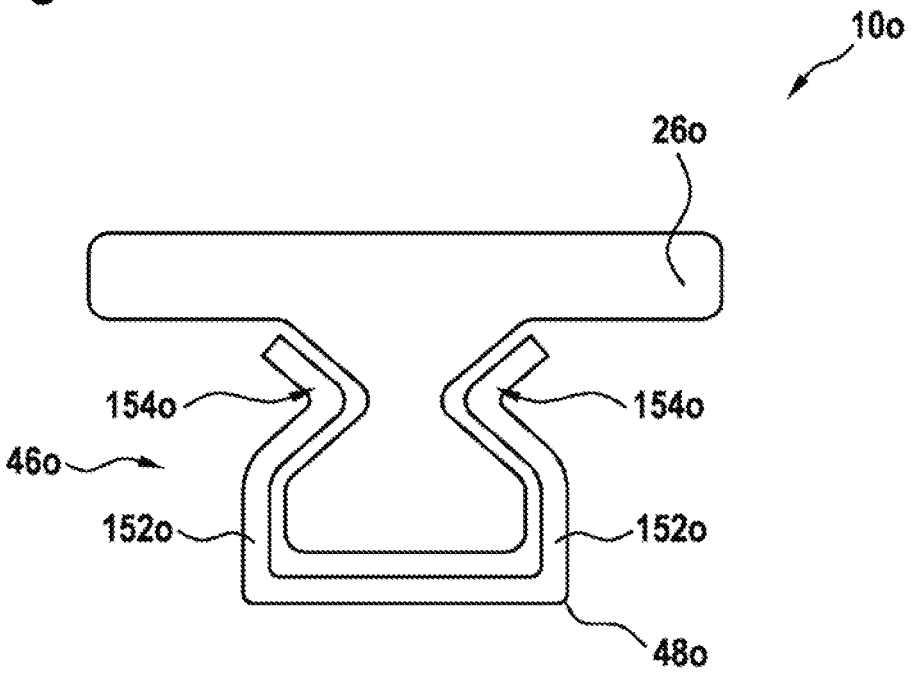

FIG. 15 shows a holding unit 46*o* of a quick-change clamping device 10*o* in a detail view from the side. The holding unit 46*o* is designed to be arranged on a transmission housing unit of a portable power tool (not shown here). The holding unit 46*o* is designed to hold the control element 26*o* in at least one movement position of the control element 26*o*. Advantageously, the holding unit 46*o* is designed to hold the control element 26*o* for the purpose of realizing a release position and/or a clamping position of a clamping unit (see FIG. 1*b*), not shown here. Preferably, the holding unit 46*o* is designed to hold the control element 26*o* for the purpose of realizing a release position of the clamping unit. Advantageously, the holding unit 46*o* has at least one positive-engagement element 48*o*, advantageously at least two positive-engagement elements 480. The positive-engagement element 48*o* is designed to realize a latching connection to the control element 26*o*. In particular, the positive-engagement element 48*o* encompasses the control element 26*o*, at least to a large extent. The positive-engagement element 48*o* is made, at least partly, from a resilient material. The positive-engagement element 48*o* is preferably made, at least partly, from plastic. Alternatively, the positive-engagement element 48*o* may be made from metal. The positive-engagement element 48*o* has, at least in part, an at least partly U-shaped cross section (not denoted by a reference). A contour of the U-shaped cross section of the positive-engagement element 48*o* corresponds, at least partly, to an outer contour of a cross section of the control element 26*o*. The positive-engagement element 48*o* has at least two positive-engagement limbs 152*o*. The positive-engagement limbs 152*o* enclose the control element 26*o* from two sides of the control element 26*o* that face away from each other. At least one positive-engagement limb 152*o* of the positive-engagement limbs 152*o* has a latching lug 154*o*. The latching lug 154*o* is realized so as to correspond to a latching cutout (not denoted by a reference) of the control element 26*o*. For the purpose of fixing, the latching lug 154*o* is designed for at least partial positive engagement of the latching lug 154*o* in the latching cutout. Preferably, both positive-engagement limbs 152*o* have at least one latching lug 154*o*. Alternatively or additionally, at least one latching lug 154*o* may be arranged at an end of one of the positive-engagement limbs 152*o*, and be realized as a hook. Further, it is also possible for the positive-engagement element 48*o* to encompass the control element 26*o* completely and/or on one side, at least for the purpose of fixing in at least the release position or the clamping position of the clamping unit. Moreover, a holding element may be realized as a latching cap that has an at least substantially cylindrical outer shape, and that is designed for latching connection to a spherical element and/or to a spherical pushbutton of a control element 26*o*, and may be arranged, at least partly, on an exterior of a transmission housing unit (not shown here).

Figure 16:
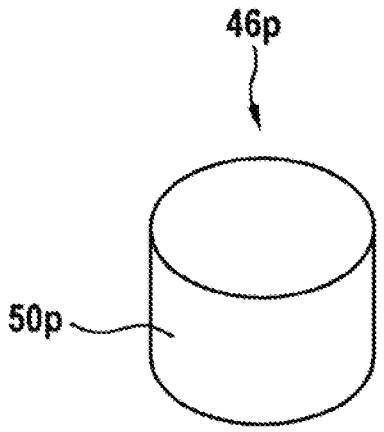

FIG. 16 shows a holding unit 46*p* in a perspective representation. The holding unit 46*p* comprises at least one magnetic element 50*p*. Preferably, the magnetic element 50*p* is arranged, at least partly, on an exterior of a transmission housing unit of a portable power tool (not shown here). The magnetic element 50*p* is designed to hold a control element, not shown here, that is made of a ferromagnetic material. The magnetic element 50*p* is designed to hold the control element in at least one movement position of the control element. Advantageously, the magnetic element 50*p* is designed to hold the control element for the purpose of realizing a release position and/or a clamping position of a clamping unit (see FIG. 1*b*), not shown here. Preferably, the magnetic element 50*p* is designed to hold the control element for the purpose of realizing a release position of the clamping unit.

Figure 17:
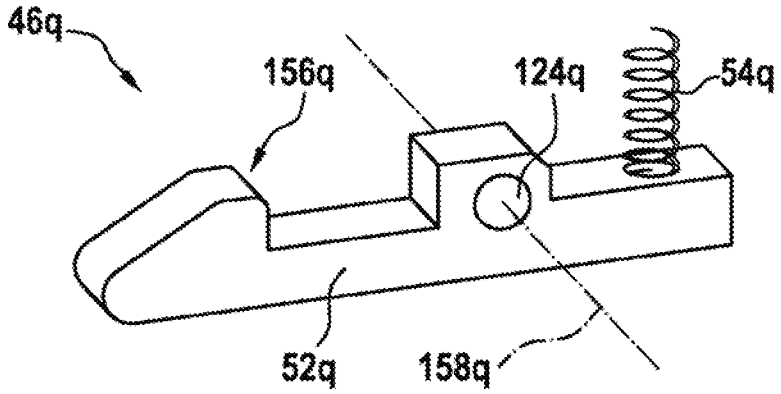

FIG. 17 shows a holding unit 46*q* in a perspective representation. The holding unit 46*q* comprises at least one holding element 52*p*. The holding element 52*q* is realized as a catch-on lever. The holding element 52*q* comprises a catch-on projection 156*q*, which is designed for catch-on connection to a corresponding holding element 52*q* of a control element (not shown here). The holding unit 46*q* also has a holding spring element 54*q*. The holding spring element 54*q* is made from metal. The holding spring element 54*q* is arranged on the holding element 52*q*. The holding spring element 54*q* is preferably connected by positive and/non-positive engagement to the holding element 52*q*. The holding spring element 54*q* is realized as a restoring spring. Alternatively, the holding spring element 54*q* may be at least partly integrally connected to the holding element 52*q*. The holding element 46*q* is mounted so as to be rotatable about a pivot joint 124*q*. Preferably, the holding unit 46*q* is mounted so as to be rotatable about a rotation axis 158*q* of the holding unit 46*q*. The holding unit 46*q* is mounted so as to be rotatable about the rotation axis 158*q* by means of an operator force. By means of the operator force, a catch-on connection can be realized between the holding unit 46*q* and the control element. Preferably, the catch-on connection between the holding unit 46*q* and the control element can be realized in a release position of a clamping unit, not shown here.

Figure 18:
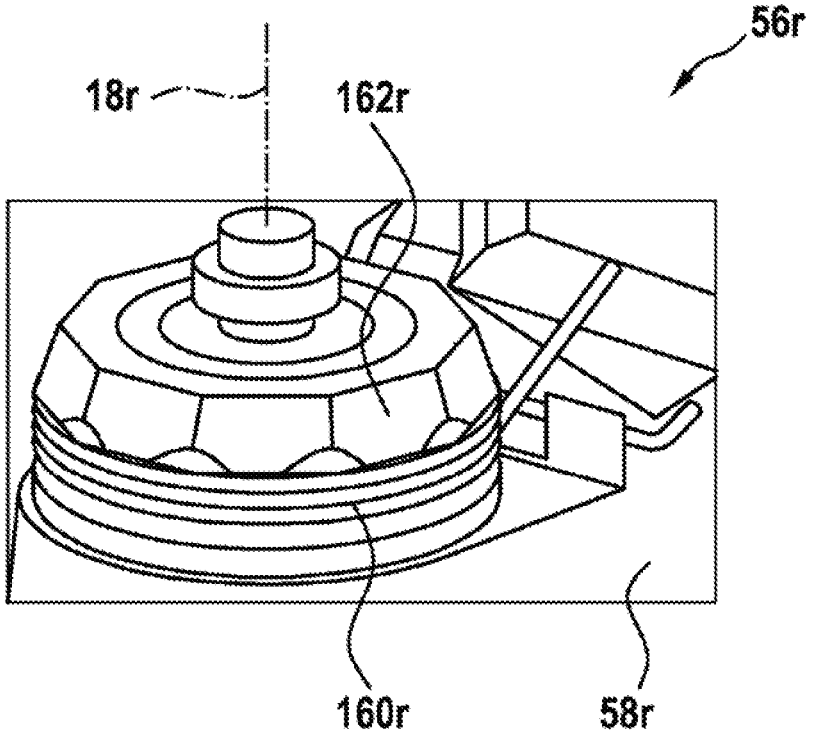

FIG. 18 shows a damping unit 56*r* of a quick-change clamping device in a perspective detail view. The damping unit 56*r* is arranged, at least partly, on an exterior of a transmission housing unit 58*r*, shown only partially here, of a portable power tool. Advantageously, the damping unit 56*r* is arranged, at least partly, in a region close to a control element, not shown here. The damping unit 56*r* is designed to damp a restoring movement of the control element. The damping unit 56*r* is designed to apply a frictional force to the control element. The damping unit 56*r* is designed to absorb, at least partly, a restoring force of the control element. The damping unit 56*r* is realized as a wrap spring brake. The damping unit 56*r* has a brake body 162*r*. The brake body 162*r* is connected to a control element, not shown here, in a rotationally fixed manner. Alternatively, the brake body 162*r* may be connected to an actuating element, not shown here, in a rotationally fixed manner. Advantageously, a rotation axis (not shown here) is aligned at least substantially parallel to a movement axis 18*r* of a clamping unit (see FIG. 1*b*), not shown here. The damping unit 56*r* has at least one damping element 160*r*, realized as a wrap spring wire. Advantageously, the damping element 160*r* is connected to the control element by non-positive and/or positive engagement at a first end of the damping element 160*r*. At a further end of the damping element 160*r* that is opposite to the first end of the damping element 160*r*, the damping element 160*r* is connected at least by non-positive and/or positive engagement to a holding unit (not shown here) and/or to the transmission housing unit 58*r*. Alternatively, a damping unit 56*r* may be realized as a pneumatic or hydraulic damping unit 56*r*, and/or as a damping unit considered appropriated by persons skilled in the art.

The invention claimed is:

1. A quick-change clamping device for a portable power tool, comprising:

at least one clamping unit having at least one clamping element mounted movably with respect to a movement axis of the clamping unit such that the clamping unit is configured to fix an insert tool unit to an output shaft of the portable power tool without the use of any tools; and at least one control unit having at least one movably mounted control element configured to actuate the clamping unit, the control element mounted in at least a translational manner and configured to bring the clamping unit from a clamping position into a release position in dependence on a movement of the control element, wherein the control element is configured as a pushbutton and has a movement axis that runs at least substantially parallel to the movement axis of the clamping unit, and wherein the at least one clamping unit includes an arcuate coulisse element in which a securing unit is arranged, the securing unit being operably connected to the control element such that movement of the pushbutton along the movement axis causes movement of the securing unit along the movement axis within the coulisse element, pivoting the coulisse element about a pivot axis so as to move the at least one clamping element from the clamping position to the release position.

2. The quick-change clamping device as claimed in claim 1, wherein the portable power tool is configured as power angle grinder.

3. The quick-change clamping device as claimed in claim 1, wherein the control element is configured to transmit a force exerted at least substantially vertically upon the control element by an operator to an actuating element and/or the clamping unit.

4. The quick-change clamping device as claimed in claim 3, wherein the control element is configured to transmit the force that is exerted by the operator as a pressure force exerted at least substantially parallel to the movement axis of the clamping unit to the actuating element and/or the clamping unit.

5. The quick-change clamping device as claimed in claim 1, wherein the control element has at least one contact bolt arranged, at least largely, in an inner region of a transmission housing unit, the at least one contact bolt being connected to or integral with the pushbutton.

6. The quick-change clamping device as claimed in claim 5, wherein the contact bolt is configured to be contacted, at least in an operating state, to move the clamping unit from the clamping position into the release position, and to transmit an operator force to an actuating element and/or the clamping unit.

7. The quick-change clamping device as claimed in claim 1, wherein the contact element is mounted by a resilient restoring element that exerts a restoring force on the contact element so as to urge the contact element toward a non-actuated position.

8. The quick-change clamping device as claimed in claim 1, wherein the pushbutton is formed from a plastic or from a metal.

9. The quick-change clamping device as claimed in claim 1, wherein the control element is arranged, at least in part, on an exterior of a transmission housing unit.

10. The quick-change clamping device as claimed in claim 1, wherein the control element is arranged, at least in part, in an inner region of a transmission housing unit.

11. The quick-change clamping device as claimed in claim 1, wherein the pushbutton is configured such that actuation of the pushbutton by an operator with a force exerted at least substantially vertically upon the pushbutton is transmitted to an actuating element, which is operably connected to the securing unit.

12. The quick-change clamping device as claimed in claim 11, wherein a decoupling element and a connection element are arranged between the actuating element and the securing unit, and configured such that actuation of the pushbutton moves the actuating element, the decoupling element, and the connection element along the movement axis so as to move the securing unit along the movement axis.

13. The quick-change clamping device as claimed in claim 1, wherein the securing unit and the coulisse element are configured such that, when moved into the release position, pivoting of the coulisse element and engagement between the securing element and the coulisse element locks the coulisse element and the at least one clamping element in the release position.

14. A portable power tool, comprising:

at least one quick-change clamping device including:

at least one clamping unit having at least one clamping element mounted movably with respect to a movement axis of the clamping unit such that the clamping unit is configured to fix an insert tool unit to an output shaft of the portable power tool without the use of any tools, and at least one control unit having at least one movably mounted control element configured to actuate the clamping unit, the control element mounted in at least a translational manner and configured to bring the clamping unit from a clamping position into a release position in dependence on a movement of the control element, wherein the control element is configured as a pushbutton and has a movement axis that runs at least substantially parallel to the movement axis of the clamping unit, and wherein the at least one clamping unit includes an arcuate coulisse element in which a securing unit is arranged, the securing unit being operably connected to the control element such that movement of the pushbutton along the movement axis causes movement of the securing unit along the movement axis within the coulisse element, pivoting the coulisse element about a pivot axis so as to move the at least one clamping element from the clamping position to the release position.

15. The portable power tool as claimed in claim 14, wherein the portable power tool is configured as a power angle grinder.

* * * * *